US005290673A

United States Patent [19]

Nishikawa

[11] Patent Number: 5,290,673

[45] Date of Patent: * Mar. 1, 1994

[54] SILVER HALIDE PHOTOGRAPHIC LIGHT-SENSITIVE MATERIAL

[75] Inventor: Toshihiro Nishikawa, Minami-Ashigara, Japan

[73] Assignee: Fuji Photo Film Co., Ltd., Kanagawa, Japan

[ * ] Notice: The portion of the term of this patent subsequent to Jan. 7, 2009 has been disclaimed.

[21] Appl. No.: 774,650

[22] Filed: Oct. 15, 1991

Related U.S. Application Data

[63] Continuation of Ser. No. 453,836, Dec. 20, 1989, abandoned.

[30] Foreign Application Priority Data

Dec. 22, 1988 [JP] Japan ..... 63-324598

[51] Int. Cl.[5] ..... G03C 1/005; G03C 1/08

[52] U.S. Cl. ..... 430/567; 430/569; 430/603; 430/607; 430/611; 430/613

[58] Field of Search ..... 430/613, 611, 607, 603, 430/567, 569

[56] References Cited

U.S. PATENT DOCUMENTS

| | | | |
|---|---|---|---|
| 3,047,393 | 7/1962 | Herz et al. . | |
| 3,892,574 | 7/1975 | Claes et al. | 430/596 |
| 3,957,490 | 5/1976 | Libeer et al. . | |
| 4,276,374 | 6/1981 | Mifune et al. | 430/603 |
| 4,720,451 | 1/1988 | Shuto et al. | 430/613 |
| 4,923,793 | 5/1990 | Shibahara | 430/611 |
| 5,061,614 | 10/1991 | Takada et al. | 430/569 |
| 5,079,138 | 1/1992 | Takada | 430/567 |
| 5,096,806 | 3/1992 | Nakamura et al. | 430/567 |

FOREIGN PATENT DOCUMENTS

| | | |
|---|---|---|
| 2169360 | 9/1973 | France . |
| 1275701 | 5/1972 | United Kingdom . |
| 2176304 | 12/1986 | United Kingdom . |

OTHER PUBLICATIONS

Birr, "Stabilization of Photographic silver halide emulsions", G.B., London, Focal Press, 1974 275 blz. G.B. 1974.

Patent Abstracts of Japan, vol. 13, 98, P-840 (3446), 1989.

*Primary Examiner*—Thorl Chea

*Attorney, Agent, or Firm*—Birch, Stewart, Kolasch & Birch

[57] ABSTRACT

An emulsion layer containing silver halide grains reduction-sensitized by an ascorbic acid or at least one of its derivatives and containing a nitrogen-containing heterocyclic compound having a mercapto group is formed on a support.

21 Claims, No Drawings

SILVER HALIDE PHOTOGRAPHIC LIGHT-SENSITIVE MATERIAL

This application is a continuation of application Ser. No. 07/453,836 filed on Dec. 20, 1989, now abandoned.

BACKGROUND OF THE INVENTION

1. Field of the Invention

The present invention relates to a silver halide photographic light-sensitive material and, more particularly, to a silver halide color photographic light-sensitive material having high sensitivity, producing low fog, and having good storage stability.

2. Description of the Related Art

Basic properties required for a photographic silver halide emulsion are high sensitivity, low fogging density, and fine graininess.

In order to increase the sensitivity of an emulsion, (1) to increase the number of photons absorbed by a single grain, (2) to increase the efficiency of converting photoelectrons generated by light absorption into a silver cluster (latent image), and (3) to increase developability for effectively utilizing the obtained latent image, are required. Increasing the size increases the number of photons absorbed by a single grain but degrades graininess. Increasing the development activity is an effective means of increasing the sensitivity. In the case of parallel development such as color development, however, the graininess is generally degraded. In order to increase the sensitivity without degrading graininess, it is most preferable to increase the efficiency of converting photoelectrons into a latent image, i.e., increase a quantum efficiency. In order to increase the quantum efficiency, a low-efficiency process such as recombination and latent image dispersion must be minimized. It is known that a reduction sensitization method of forming a small silver nucleus without development activity inside or on the surface of a silver halide grain is effective to prevent recombination.

The method of reduction sensitization has been studied for a long time. Carroll, Lowe et al., and Fallens et al. disclose that a tin compound, a polyamine compound, and a thiourea dioxide-based compound are effective as a reduction sensitizer in U.S. Pat. Nos. 2,487,850 and 2,512,925 and British Patent 789,823, respectively. Collier compares properties of silver nuclei formed by various reduction sensitization methods in "Photographic Science and Engineering", Vol. 23, P. 113 (1979). She adopted methods of dimethylaminoborane, stannous chloride, hydrazine, high-pH ripening, and low-pAg ripening. Reduction sensitization methods are also disclosed in U.S. Pat. Nos. 2,518,698, 3,201,254, 3,411,917, 3,779,777, and 3,930,867. Not only selection of a reduction sensitizer but also improvements in a reduction sensitization method are described in JP-B-57-33572 and JP-B-58-1410 ("JP-B-" means examined Japanese patent application). In these disclosures, conventional reduction sensitizers are enumerated, and ascorbic acid is included therein. In these disclosures, however, a compound such as thiourea dioxide is considered to be preferable, and thiourea dioxide, silver ripening, and hydrazine are exemplified. Therefore, preferable properties of an ascorbic acid compound as a reduction sensitizer have not been yet found. A method of using the ascorbic acid compound is disclosed in JP-A-57-179835 ("JP-A" means unexamined published Japanese patent application). Techniques of improving storage stability of a reduction-sensitized emulsion are disclosed in JP-A-57-82831 and JP-A-60-178445, but improvements have not reached a sufficient level.

Regardless of the number of studies as described above, an increase in sensitivity is insufficient as compared with that obtained in hydrogen sensitization in which a light-sensitive material is subjected to a vacuum and then treated with hydrogen gas. This is reported by Moisar et al. in "Journal of Imaging Science", Vol. 29, P. 233 (1985). A demand has also arisen for improvements in storage stability of a light-sensitive material containing a reduction-sensitized emulsion.

As described above, the conventional techniques of reduction sensitization are insufficient to satisfy a recent demand for a photographic light-sensitive material with high sensitivity and high image quality. In addition, an emulsion prepared by these sensitization techniques have poor storage stability.

SUMMARY OF THE INVENTION

It is a first object of the present invention to provide a silver halide photographic light-sensitive material having high sensitivity and good graininess, producing low fog, and having good storage stability.

It is a second object of the present invention to provide a color light-sensitive material having high sensitivity, producing low fog, and having good storage stability.

The above objects of the present invention are achieved by the following silver halide photographic light-sensitive material.

That is, according to the present invention, there is provided a silver halide photographic light-sensitive material comprising, on its support, an emulsion layer containing silver halide grains reduction-sensitized by ascorbic acid or at least on of its derivatives and containing a nitrogen-containing heterocyclic compound having a mercapto group.

DESCRIPTION OF THE PREFERRED EMBODIMENTS

Process of manufacturing silver halide emulsions are roughly classified into, e.g., grain formation, desalting, chemical sensitization, and coating steps. Grain formation is further classified into e.g. nucleation, physical ripening, and precipitation substeps. These steps are performed not in the above-mentioned order but in a reverse order or repeatedly.

In principle, reduction sensitization can be performed in any step of a process of manufacturing a silver halide emulsion. That is, reduction sensitization can be performed during any of nucleation, physical ripening, precipitation as initial stages of grain formation, or before, after, or simultaneously with sulfur sensitization, selenium sensitization, or gold sensitization.

In the present invention, reduction sensitization is preferably performed before or simultaneously with sulfur sensitization, selenium sensitization, or gold sensitization.

Examples of ascorbic acid and its derivative (to be referred to as an "ascorbic acid compound" hereinafter) are as follows:

(A-1): Ascorbic Acid
(A-2): L-ascorbic Acid
(A-3): Sodium L-ascorbate
(A-4): Potassium L-ascorbate
(A-5): DL-ascorbic Acid
(A-6): Sodium D-ascorbate (A-7): L-ascorbic acid 6-acetate
(A-8): L-ascorbic acid 6-palmitate
(A-9): L-ascorbic acid 6-benzoate
(A-10): L-ascorbic acid 5,6-diacetate
(A-11): L-ascorbic acid 5,6-O-isopropylidene In order to add the above ascorbic acid compounds in a process of manufacturing a silver halide emulsion used in the present invention, they can be dispersed directly in an emulsion, or can be dissolved in a solvent or solvent mixture of, e.g., water, methanol, and ethanol and then added to a emulsion in the manufacturing process.

In the present invention, it is desired that the ascorbic acid compound is used in an amount much larger than a preferable addition amount of a conventional reduction sensitizer. For example, JP-B-57-33572 describes "an amount of a reducing agent normally does not exceed $0.75\times10^{-2}$ milli equivalent amount per gram of silver ions ($8\times10^{-4}$ mol/AgX mo). An amount of 0.1 to 10 mg per kg of silver nitrate ($10^{-7}$ to $10^{-5}$ mol/AgX mol for ascorbic acid) is effective in many cases" (reduced values are calculated by the present inventors). U.S. Pat. No. 2,487,850 describes that "a tin compound can be used as a reduction sensitizer in an addition amount of $1\times10^{-7}$ to $44\times10^{-6}$ mol". JP-A-57-179835 describes that it is suitable to add about 0.01 mg to about 2 mg of thiourea dioxide or about 0.01 mg to about 3 mg of stannous chloride per mol of a silver halide. A preferable addition amount of the ascorbic acid compound used in the present invention depends on factors such as grain size and halogen composition of an emulsion, temperature, pH, and pAg in emulsion preparation. The addition amount, however, is selected from a range of, preferably, $5\times10^{-5}$ mol to $1\times10^{-1}$ mol, more preferably, $5\times10^{-4}$ mol to $1\times10^{-2}$ mol, and most preferably, $1\times10^{-3}$ mol to $1\times10^{-2}$ mol per mol of a silver halide.

In some cases, the method of performing reduction sensitization using the ascorbic acid compound is preferably combined with another reduction sensitization method. A method to be used in combination with the method in which the ascorbic acid is used can be selected from a method of adding a known reducing agent to a silver halide emulsion, a method called silver ripening in which precipitation or ripening is performed in a low-pAg atmosphere of a pAg of 1 to 7, and a method called high-pH ripening in which precipitation or ripening is performed in a high-pH atmosphere of a pH of 8 to 11.

A method of adding a reduction sensitizer is preferable because the level of reduction sensitization can be precisely adjusted.

As the reduction sensitizer, for example, stannous salt, amines and polyamines, a hydrazine derivative, formamidinesulfinic acid, a silane compound, and a borane compound are known.

In the present invention, a nitrogen-containing heterocyclic compound having a mercapto group can be added in any step of a process of manufacturing a silver halide emulsion. For example, the compound can be added during any of nucleation, physical ripening, and precipitation as initial stages of grain formation, before or after chemical sensitization, or immediately before coating. In the case of adding the nitrogen containing heterocyclic compound having a mercapto group in a coating step, if a compound which is described later in respect to formula (I) or (II) is diffusive, the compound generally can be added to either the same layer as the emulsion of the present invention which is reduction-sensitized by ascorbic acid or its derivative or another layer coated on the emulsion layer and having water permeability with respect to the emulsion layer. In either case, the objects of the present invention can be achieved. An addition amount of the nitrogen-containing heterocyclic compound having a mercapto group must be preferably selected. The addition amount is preferably $10^{-6}$ to $10^{-2}$ mol per mol of a silver halide.

In the present invention, examples of the nitrogen-containing heterocyclic compound are preferably a compound represented by formula (I) below, and more preferably, a compound represented by formula (II).

Formula (I)

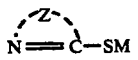

wherein Z represents a non-metallic atom group required to form a nitrogen-containing heterocyclic ring, M represents a hydrogen atom, an alkali metal, quaternary ammonium, or quaternary phosphonium.

Formula (II)

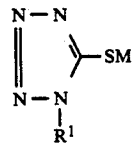

wherein $R^1$ represents an aliphatic group, an aromatic group, or a heterocyclic group each substituted by at least one of —COOM or —$SO_3M$, and M has the same meaning as that in formula (I).

A nitrogen-containing heterocyclic compound represented by formulas (I) and (II) for use in the present invention will be described in detail below.

Examples of the aliphatic group represented by $R^1$ in formula (II) are a straight-chain or branched alkyl group having 1 to 20 carbon atoms (e.g., methyl, propyl, hexyl, dodecyl, and isopropyl), and a cycloalkyl group having 1 to 20 carbon atoms (e.g., cyclopropyl and cyclohexyl); an example of its aromatic group is an aryl group having 6 to 20 carbon atoms (e.g., phenyl and naphthyl); and an example of its heterocyclic group is a 5-, 6-, or 7-membered heterocyclic ring containing one or more nitrogen, oxygen, or sulfur atoms (e.g., morpholino, piperidino, and pyridine). The heterocyclic group also includes rings forming a condensed ring at a suitable position (e.g., a quinoline ring, a pyrimidine ring, and an isoquinoline ring).

The straight-chain or branched alkyl group, the cycloalkyl group, the aryl group, and the heterocyclic group described above may have substituents in addition to —COOM or —$SO_3M$. Examples of the substituent are a halogen atom (F, Cl, and Br), an alkyl group (e.g., methyl and ethyl), an aryl group (e.g., phenyl and p-chlorophenyl), an alkoxy group (e.g., methoxy and methoxyethoxy), an aryloxy group (e.g., phenoxy), a sulfonyl group (e.g., methanesulfonyl and p-toluenesulfonyl), a sulfonamide group (e.g., methanesulfonamide and benzenesulfonamide), a sulfamoyl group (e.g., diethylsulfamoyl and unsubstituted sulfamoyl), a carbamoyl group (e.g., unsubstituted carbamoyl and diethylcarbamoyl), an amide group (e.g., acetamide and benzamide), an ureido group (e.g., methylureido and phenylureido), an alkoxycarbonylamino group (e.g., methoxycarbonylamino), an aryloxycarbonylamino group (e.g., phenoxycarbonylamino), an alkoxycarbonyl group (e.g., methoxycarbonyl), an aryloxycarbonyl group (e.g., phenoxycarbonyl), a cyano group, a hydroxy group, a carboxyl group, a sulfo group, a nitro group, an amino group (e.g., unsubstituted amino and dimethylamino), an alkylsulfinyl group (e.g., methoxysulfinyl), an arylsulfinyl group (e.g., phenylsulfinyl), an alkylthio group (e.g., methylthio), and an arylthio group (e.g., phenylthio). Two or more of these substituents may substitute, or the types of substituents may be the same or different.

The most preferable example of nitrogen-containing heterocyclic compounds represented by formulas (I) and (II) is a compound represented by formula (III):

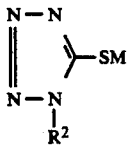

Formula (III)

wherein $R^2$ represents a phenyl group substituted by at least one —COOM or —$SO_3M$, and M has the same meaning as that in formula (I). This phenyl group represented by $R^2$ may be substituted by other substituents in addition to —COOM or —$SO_3M$. Examples of other substituents are the same substituents as those of the straight-chain or branched alkyl group, the cycloalkyl group, the aryl group, and the heterocyclic group represented by $R^1$ described above. If two or more —COOM and —$SO_3M$ are present, they may be the same or different.

Preferable examples of the nitrogen-containing heterocyclic compound having a mercapto group for use in the present invention will be listed in Table A to be presented later. The present invention, however, is not limited to those examples.

As is well known to those skilled in the art, the above compound can be easily synthesized by utilizing a reaction between isothiocyanate and sodium azide. For reference, literatures and patents concerning the synthesizing method wil be enumerated below.

U.S. Pat. No. 3,266,897; JP-B-42-21842; JP-A-56-111846; British Patent 1,275,701; D. A. Berges et al., "Journal of Heterocyclic Chemistry", Vol. 15, P. 981 (1978); R. G. Dubenko and V. D. Panchenko, "Khimiia Geterotsiklicheskikh Soedinenii", Vol. 1, "Azole oder Jhaschie Geterotsikly", 1967, PP. 199 to 201.

The compound may be added to an emulsion in accordance with a conventional addition method of a photographic emulsion additive. For example, the compound may be dissolved in methyl alcohol, ethyl alcohol, methylcellosolve, acetone, water, or a solvent mixture thereof, and then added in the form of a solution.

The use of a compound represented by formula (I) in the field of photography is already known to those skilled in the art. For example, JP-A-62-89952 describes that fog is prevented and high sensitivity is obtained by a combination of a nitrogen-containing heterocyclic compound having a mercapto group and a cyanine dye. It is totally unexpected, however, that the storage stability of a silver halide photographic light-sensitive material reduction-sensitized by the ascorbic acid compound of the present invention is improved by these conventional techniques.

In the present invention, it is preferred to add at least one compound selected from compounds represented by formulas (IV), (V), and (VI) during the manufacturing process.

(IV) $R\text{-}SO_2S\text{—}M$ (V) $R\text{—}SO_2S\text{—}R^1$ (VI) $RSO_2S\text{—}L_m\text{—}SSO_2\text{—}R^2$ wherein, R, $R^1$, and $R^2$ can be the same or different and represent an aliphatic group, an aromatic group, or a heterocyclic group, M represents a cation, L represents a divalent bonding group, m represents 0 or 1.

Compounds represented by formulas (IV), (V), and (VI) will be described in more detail below. When R, $R^1$ and $R^2$ each represent an aliphatic group, it is preferably alkyl having 1 to 22 carbon atoms or alkenyl or alkynyl having 2 to 22 carbon atoms. These groups can have substituents. Examples of the alkyl are methyl, ethyl, propyl, butyl, pentyl, hexyl, octyl, 2-ethylhexyl, decyl, dodecyl, hexadecyl, octadecyl, cyclohexyl, isopropyl, and t-butyl.

Examples of the alkenyl are allyl and butenyl.

Examples of the alkynyl are propargyl and butynyl.

A preferable aromatic group represented by R, $R^1$, and $R^2$ includes aromatic group having 6 to 20 carbon atoms. Examples of such an aromatic group are phenyl and naphthyl. These groups can have substituents.

A heterocyclic group represented by R, $R^1$, and $R^2$ includes a 3- to 15-membered ring having at least one element of nitrogen, oxygen, sulfur, selenium, and tellurium. Examples of the heterocyclic group are pyrrolidine, piperidine, pyridine, tetrahydrofurane, thiophene, oxazole, thiazole, imidazole, benzothiazole, benzoxazole, benzimidazole, selenazole, benzoselenazole, tellurazole, triazole, benzotriazole, tetrazole, oxadiazole, and thiadiazole.

Examples of the substituent on R, $R^1$, and $R^2$ are an alkyl group (e.g., methyl, ethyl, and hexyl), an alkoxy group (e.g., methoxy, ethoxy, and octyloxy), an aryl group (e.g., phenyl, naphthyl, and tolyl), a hydroxyl group, a halogen atom (e.g., fluorine, chlorine, bromine, and iodine), an aryloxy group (e.g. phenoxy), an alkylthio group (e.g., methylthio and butylthio), an arylthio group (e.g. phenylthio), an acyl group (e.g. acetyl, propionyl, butyryl, and valeryl), a sulfonyl group (e.g. methyl sulfonyl and phenylsulfonyl), an acylamino group (e.g., acetylamino and benzoylamino), a sulfonylamino group (e.g., methanesulfonylamino and benzenesulfonylamino), an acyloxy group (e.g., acetoxy and benzoxy), carboxyl group, cyano group, sulfo group, and amino group.

Preferably L represents a divalent aliphatic group or a divalent armoatic group. Examples of the divalent aliphatic represented by L are $(CH_2)_n$ (n=1 to 12), $\text{—}CH_2\text{—}CH{=}CH\text{—}CH_2\text{—}$, $\text{—}CH_2C{\equiv}CCH_2\text{—}$,

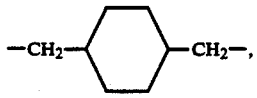

and xylylene. Examples of the divalent aromatic group represented by L are phenylene and naphthylene.

These substituents can have further substituents above-mentioned.

M is preferably a metal ion or an organic cation. Examples of the metal ion are a lithium ion, a sodium ion, and a potassium ion. Examples of the organic cation are an ammonium ion (e.g., ammonium, tetramethylammonium, and tetrabutylammonium), a phosphonium ion (e.g. tetraphenylphosphonium), and a guanidino group.

A compound represented by formula (IV) can be easily synthesized by methods described in JP-A-54-1019 and British Patent 972,211.

A compound represented by formula (IV), (V), or (VI) is preferably added in an amount of $10^{-7}$ to $10^{-1}$ mol per mol of a silver halide. The addition amount is more preferably $10^{-6}$ to $10^{-2}$ mol/molAg and most preferably $10^{-5}$ to $10^{-3}$ mol/molAg.

A conventional method of adding an additive in a photographic emulsion can be adopted to add compounds represented by formulas (I) to (III) in a manufacturing process. For example, a water-soluble compound can be added in the form of an aqueous solution having an arbitrary concentration, and a water-insoluble or slightly water-soluble compound is dissolved in an arbitrary organic solvent such as alcohols, glycols, ketones, esters, and amides, which is miscible with water and does not adversely affect photographic properties, and then added as a solution.

A compound represented by formula (IV), (V), or (VI) can be added at any time during the manufacturing process, e.g., during grain formation of a silver halide emulsion or before or after chemical sensitization. The compound is preferably added before or during reduction sensitization.

A silver halide grain to be used in the present invention can be selected from a regular crystal not including a twinning plane and those described in Japan Photographic Society ed., "Silver Salt Photographs, Basis of Photographic Industries", (Corona Co., P. 163) such as a single twined crystal including one twinning plane, a parallel multiple twined crystal including two or more parallel twinning plane, and a non-parallel multiple twined crystal including two or more non-parallel twinning plane, in accordance with its application. In the case of a regular crystal, a cubic grain consisting of (100) faces, an octahedral grain consisting of (111) faces, and a dodecahedral grain consisting of (110) faces disclosed in JP-B-55-42737 and JP-A-60-222842 can be used. In addition, a grain having (hl1), e.g., (211) faces, a grain having (hh1), e.g., (331) faces, a grain having (hk0), e.g., (210) faces, and a grain consisting of (hk1), e.g., (321) faces as reported in "Journal of Imaging Science", Vol. 30, P. 247, 1986 can be selectively used in accordance with an application although a preparation method must be improved. A grain including two or more types of faces, e.g., a tetradecahedral grain having both (100) and (111) faces, a grain having both (100) and (110) faces, and a grain having both (111) and (110) faces can be selectively used in accordance with an application.

The grain of a silver halide can be a fine grain having a grain size of 0.1 microns or less or a large grain having a projected surface area diameter of 10 microns. An emulsion can be a monodispersed emulsion having a narrow size distribution or a polydispersed emulsion having a wide size distribution.

A so-called monodispersed silver halide emulsion having a narrow size distribution, i.e., in which 80% or more (the number or weight of grains) of all grains fall within the range of ±30% of an average grain size can be used in the present invention. In order to satisfy target gradation of a light-sensitive material, two or more types of monodispersed silver halide emulsions having different grain sizes can be coated in a single layer or overlapped in different layers in emulsion layers having substantially the same color sensitivity. Alternatively, two or more types of polydispersed silver halide emulsions or a combination of monodispersed and polydispersed emulsions can be mixed or overlapped.

The photographic emulsions for use in the present invention can be prepared by using methods described in, for example, P. Glafkides, "Chimie et Physique Photographique", Paul Montel, 1967; Duffin, "Photographic Emulsion Chemistry", Focal Press, 1966; and V. L. Zelikman et al., "Making and Coating Photographic Emulsion", Focal Press, 1964. That is, the photographic emulsion can be prepared by, e.g., an acid method, a neutralization method, and an ammonia method. Also, as a system for reacting a soluble silver salt and a soluble halide, a single mixing method, a double mixing method, or a combination thereof can be used. Also, a so-called back mixing method for forming silver halide grains in the presence of excessive silver ions can be used. As one system of the double mixing method, a so-called controlled double jet method wherein the pAg in the liquid phase, where the silver halide is generated, kept at a constant value can be used. According to this method, a silver halide emulsion having a regular crystal form and almost uniform grain sizes is obtained.

The silver halide emulsion containing the above-described regular silver halide grains can be obtained by controlling the pAg and pH during grain formation. More specifically, such a method is described in "Photographic Science and Engineering", Vol. 6, 159–165 (1962); "Journal of Photographic Science", Vol. 12, 242–251 (1964); U.S. Pat. No. 3,655,394, and British Patent 1,413,748.

A tabular grain having an aspect ratio of 3 or more can also be used in the present invention. The tabular grain can be easily prepared by methods described in, for example, Cleve, "Photography Theory and Practice", (1930), P. 131; Gutoff, "Photographic Science and Engineering", Vol. 14, PP. 248 to 257, (1970); and U.S. Pat. Nos. 4,434,226, 4,414,310, 4,433,048 and 4,439,520 and British Patent 2,112,157. When the tabular grain is used, covering power and a spectral sensitizing efficiency of a sensitizing dye can be advantageously improved as described in detail in U.S. Pat. No. 4,434,226.

The tabular grains are preferably used in the emulsion of the present invention. In particular, tabular grains in which grains having aspect ratios of 3 to 8 occupy 50% or more of a total projected surface area are preferable.

A silver halide grain for use in the present invention can have a uniform crystal structure, different halogen compositions inside and outside a crystal, or can be layered structure. These grains are disclosed in, e.g., British Patent 1,027,146, U.S. Pat. Nos. 3,505,068 and 4,444,877, and Japanese Patent Application No. 58-248469. In addition, a silver halide having different compositions can be bonded by an epitaxial junction, or a compound other than a silver halide such as silver rhodanate or zinc oxide can be bonded.

The silver halide emulsion of the present invention preferably has a distribution or structure in respect to a halogen composition in its grain. A typical example is a core-shell type o double structured grain having different halogen compositions in the interior and surface layer of the grain as disclosed in, e.g., JP-B-43-13162, JP-A-61-215540, JP-A-60-222845, and JP-A-61-75337. In such a grain, the shape of a core portion is sometimes identical to or sometimes different from that of the entire grain with shell. More specifically, while the core portion is cubic, the grain with a shell is sometimes cubic or sometimes octahedral. On the contrary, while the core portion is octahedral, the grain with a shell is sometimes cubic or sometimes octahedral. In addition, while the core portion is a clear regular grain, the grain with a shell is sometimes slightly deformed or sometimes does not have any definite shape. Furthermore, not a simple double structure but a triple structure as disclosed in JP-A-60-222844 or a multilayered structure of more layers can be formed, or a thin layer of a silver halide having a different composition can be formed on the surface of a core-shell double structure grain.

In order to give a structure inside the grain, a grain having not only the above surrounding structure but a so-called junction structure can be made. Examples of such a grain are disclosed in, e.g., JP-A-59-133540, JP-A-58-108526, EP 199290A2, JP-B-58-24772, and JP-A-59-16254. A crystal which to be bonded and have a composition different from that of a host crystal can be produced and bonded to an edge, corner, or face portion of the host crystal. Such a junction crystal can be formed regardless of whether the host crystal has a homogeneous halogen composition or a core-shell structure.

The junction structure can be naturally made by a combination of silver halides. In addition, the junction structure ca be made by combining a silver salt compound not having a rock salt structure, e.g., silver rhodanate or silver carbonate, with a silver halide. A non-silver salt compound such as PbO can also be used as long as the junction structure can be made.

In a silver iodobromide grain having the above structure, e.g., in a core-shell type grain, the silver iodide content can be high at a core portion and low at a shell portion or vice versa. Similarly, in a grain having the junction structure, the silver iodide content can be high in a host crystal and relatively low in a junction crystal or vice versa.

In a grain having the above structure, a boundary portion between different halogen compositions can be clear or unclear due to a mixed crystal formed by a composition difference. Alternatively, a continuous change of structure can be positively made.

The silver halide emulsion for use in the present invention can be subjected to a treatment for rounding a grain as disclosed in, e.g., EP-0096727B1 and EP-0064412B1 or a treatment of modifying the surface of a grain as disclosed in DE-2306447C2 and JP-A-60-221320.

The silver halide emulsion for use in the present invention is preferably of a surface latent image type. An internal latent image type emulsion, however, can be used by selecting a developing solution or development conditions as disclosed in JP-A-59-133542. In addition, a shallow internal latent image type emulsion in which a grain is covered with a thin shell can be used in accordance with an application.

A solvent for silver halide can be effectively used to promote ripening. For example, in a known conventional method, an excessive amount of halogen ions are supplied in a reaction vessel in order to promote ripening. Therefore, it is apparent that ripening can be promoted by only supplying a silver halide solution into a reaction vessel. In addition, another ripening agent can be used. A total amount of these ripening agents can be mixed in a dispersion medium in the reaction vessel before a silver salt and a halide are added therein, or they can be added in the reaction vessel together with one or more halides, a silver salt or a deflocculant. Alternatively, the ripening agents can be added singly in the step of adding a halide and a silver salt.

Examples of the ripening agent other than the halogen ion are ammonia, an amine compound and a thiocyanate such as an alkali metal thiocyanate, especially sodium or potassium thiocyanate and ammonium thiocyanate.

In the present invention, it is very important to perform chemical sensitization represented by sulfur sensitization and gold sensitization because significant effects can be obtained upon chemical sensitization. A portion to be subjected to the chemical sensitization differs in accordance with the composition, structure, or shape of an emulsion grain or an application of the emulsion. That is, a chemical sensitization nucleus is embedded either inside a grain or in a shallow portion from the grain surface or formed on the surface of a grain. Although the present invention is effective in any case, the chemical sensitization nucleus is most preferably formed in a portion near the surface. That is, the present invention is more effective in the surface latent image type emulsion than in the internal latent image type emulsion.

Chemical sensitization can be performed by using active gelatin as described in T. H. James, "The Theory of the Photographic Process", 4th ed., Macmillan, 1977, PP. 67 to 76. Alternatively, chemical sensitization can be performed at a pAg of 5 to 10, a pH of 5 to 8 and a temperature of 30° to 80° C. by using sulfur, selenium, tellurium, gold, platinum, palladium or irridium, or a combination of a plurality of these sensitizers as described in Research Disclosure Vol. 120, No. 12,008 (April, 1974), Research Disclosure Vol. 34, No. 13,452 (June, 1975), U.S. Pat. Nos. 2,642,361, 3,297,446, 3,772,031, 3,857,711, 3,901,714, 4,266,018, and 3,904,415, and British Patent 1,315,755. Chemical sensitization is optimally performed in the presence of a gold compound and a thiocyanate compound, a sulfur-containing compound described in U.S. Pat. Nos. 3,857,711, 4,266,018 and 4,054,457 or a sulfur-containing compound such as a hypo, thiourea compound and a rhodanine compound. Chemical sensitization can also be performed in the presence of a chemical sensitization assistant. An example of the chemical sensitization assistant is a compound known to suppress fogging and increase sensitivity in the chemical sensitization process such a azaindene, azapyridazine, and azapyrimidine. Examples of a chemical sensitization assistant modifier are described in U.S. Pat. Nos. 2,131,038, 3,411,914, 3,554,757, JP-A-58-126526 and G. F. Duffin, "Photographic Emulsion Chemistry", PP. 138 to 143.

The photographic emulsion for use in the present invention can contain various compounds in order to prevent fogging during manufacture, storage, or a photographic processing of the light-sensitive material or to stabilize photographic properties. Examples of the compound known as an antifoggant or stabilizer are azoles, e.g., benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiaziazoles, aminotriazoles, benzotriazoles, nitrobenzotriazoles, and mercaptotetrazoles (especially, 1-phenyl-5-mercaptotetrazole); mercaptopyrimidines; mercaptotriadines; a thioketo compound such as oxadrinthione; azaindenes, e.g., triazaindenes, tetraazaindenes (especially, 4-hydroxy-substituted (1,3,3a,7)tetraazaindenes), and pentaazaindenes. Examples are described in U.S. Pat. Nos. 3,954,474 and 3,982,947 and JP-B-52-28660.

The photographic emulsion for use in the present invention can be spectrally sensitized with, e.g., methine dyes. Examples of the dye to be used are a cyanine dye, merocyanine dye, a composite cyanine dye, a composite merocyanine dye, a holopolar cyanine dye, a hemicyanine dye, a styryl dye, and hemioxonol dye. Most effective dyes are those belonging to a cyanine dye, a merocyanine dye, and a composite merocyanine dye. In these dyes, any nucleus normally used as a basic heterocyclic nucleus in cyanine dyes can be used. Examples of the nucleus are pyrroline nucleus, an oxazoline nucleus, a thiozoline nucleus, a pyrrole nucleus, an oxazole nucleus, a thiazole nucleus, a selenazole nucleus, an imidazole nucleus, a tetrazole nucleus, and a pyridine nucleus; a nucleus obtained by condensing an alicyclic hydrocarbon ring to each of the above nuclei; and a nucleus obtained by condensing an aromatic hydrocarbon ring to each of the above nuclei, e.g., an indolenine nucleus, a benzindolenine nucleus, an indole nucleus, a benzoxadole nucleus, a naphthooxazole nucleus, a benzothiazole nucleus, a naphthothiazole nucleus, a benzoselenazole nucleus, a benzimidazole nucleus, and a quinoline nucleus. These nuclei can have substituent on a carbon atom.

For a merocyanine dye or composite merocyanine dye, a 5- or 6-membered heterocyclic nucleus, e.g., a pyrazoline-5-one nucleus, a thiohydantoin nucleus, a 2-thiooxazolidine-2,4-dione nucleus, a thiazolidine-2,4-dione nucleus, a rhodanine nucleus, and a thiobarbituric acid nucleus can be used as a nucleus having a ketomethylene structure.

These sensitizing dyes can be used singly or in a combination of two or more thereof. A combination of the sensitizing dyes is often used especially in order to perform supersensitization. Typical examples of the combination are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, 4,026,707, British Patents 1,344,281 and 1,507,803, JP-B-43-4936 and JP-B-53-12375, and JP-A-52-110618 and JP-A-52-109925.

The emulsion can contain, in addition to the sensitizing dye, a dye not having a spectral sensitizing effect or a substance substantially not absorbing visible light, having supersensitization.

The dye can be added in the emulsion at any time conventionally known to be effective in emulsion preparation. Most ordinarily, the dye is added after completion of chemical sensitization and before coating. However, the dye can be added at the same time as a chemical sensitizer to simultaneously perform spectral sensitization and chemical sensitization as described in U.S. Pat. Nos. 3,628,969 and 4,225,666, added before chemical sensitization as described in JP-A-58-113928, or added before completion of silver halide grain precipitation to start spectral sensitization. In addition, as described in U.S. Pat. No. 4,225,666, the above compound can be separately added such that a portion of the compound is added before chemical sensitization and the remaining portion is added thereafter. That is, as described in U.S. Pat. No. 4,183,756, the compound can be added at any timing during silver halide grain formation.

An addition amount of these compounds can be $4\times10^{-6}$ to $8\times10^{-3}$ mol per mol of a silver halide. More preferably, when a silver halide grain size is a preferable size i.e. 0.2 to 1.2 μm, an addition amount of about $5\times10^{-5}$ to $2\times10^{-3}$ mol is more effective.

The above various additives can be used in the light-sensitive material of the present invention. In addition to the above additives, however, various additives can be used in accordance with applications.

These additives are described in Research Disclosures, Item 17643 (Dec. 1978) and Item 18716 (Nov. 1979) and they are summarized in the following table.

| Additives | RD No. 17643 | RD No. 18716 |
|---|---|---|
| 1. Chemical sensitizers | page 23 | page 648, right column |
| 2. Sensitivity increasing agents | | page 648, right column |
| 3. Spectral sensitizers, super sensitizers | pages 23–24 | page 648, right column to page 649, right column |
| 4. Brighteners | page 24 | |
| 5. Antifoggants and stabilizers | pages 24–25 | page 649, right column |
| 6. Light absorbent, filter dye, ultraviolet absorbents | pages 25–26 | page 649, right column to page 650, left column |
| 7. Stain preventing agents | page 25, right column | page 650, left to right columns |
| 8. Dye image stabilizer | page 25 | |
| 9. Hardening agents | page 26 | page 651, left column |
| 10. Binder | page 26 | page 651, left column |
| 11. Plasticizers, lubricants | page 27 | page 650, right column |
| 12. Coating aids, surface active agents | pages 26–27 | page 650, right column |
| 13. Antistatic agents | page 27 | page 650, right column |

In this invention, various color couplers can be used. Specific examples of these couplers are described in above-described Research Disclosure, No. 17643, VII-C to VII-G as patent references.

Preferred examples of a yellow coupler are described in, e.g., U.S. Pat. Nos. 3,933,501, 4,022,620, 4,326,024, and 4,401,752, JP-B-58-10739, and British Patents 1,425,020 and 1,476,760.

Examples of a magenta coupler are preferably 5-pyrazolone and pyrazoloazole compounds, and more preferably, compounds described in, e.g., U.S. Pat. Nos. 4,310,619 and 4,351,897, EP 73,636, U.S. Pat. Nos. 3,061,432 and 3,725,067, Research Disclosure No. 24220 (June 1984), JP-A-60-33552, Research Disclosure No. 24230 (June 1984), JP-A-60-43659, and U.S. Pat. Nos. 4,500,630 and 4,540,654.

Examples of a cyan coupler are phenol and naphthol couplers, and preferably, those described in, e.g., U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173, West German Patent Application (OLS) No. 3,329,729, EP 121,365A, U.S. Pat. Nos. 3,446,622, 4,333,999, 4,451,559, and 4,427,767, and EP 161,626A.

Preferable examples of a colored coupler for correcting additional, undesirable absorption of a colored dye are those described in Research Disclosure No. 17643, VII-G, U.S. Pat. No. 4,163,670, JP-B-57-39413, U.S. Pat. Nos. 4,004,929 and 4,138,258, and British Patent 1,146,368.

Preferable examples of a coupler capable of forming colored dyes having proper diffusibility are those described in U.S. Pat. No. 4,366,237, British Patent 2,125,570, EP 96,570, and West German Patent Application (OLS) No. 3,234,533.

Typical examples of a polymerized dye-forming coupler are described in U.S. Pat. Nos. 3,451,820, 4,080,211, and 4,367,282, and British Patent 2,102,173.

Couplers releasing a photographically useful residue upon coupling are preferably used in the present invention. DIR couplers, i.e., couplers releasing a development inhibitor are described in the patents cited in the above-described Research Disclosure No. 17643, VII-F, JP-A-57-151944, JP-A-57-154234, JP-A-60-184248, and U.S. Pat. No. 4,248,962.

Preferable examples of a coupler imagewise releasing a nucleating agent or a development accelerator upon development are those described in British Patent 2,097,140, 2,131,188, and JP-A-59-157638 and JP-A-59-170840.

Examples of a coupler which can be used in the light-sensitive material of the present invention are competing couplers described in, e.g., U.S. Pat. No. 4,130,427; poly-equivalent couplers described in, e.g., U.S. Pat. Nos. 4,283,472, 4,338,393, and 4,310,618; DIR redox compound releasing couplers, a DIR coupler releasing coupler, a DIR coupler releasing redox compound, or a DIR redox releasing redox compound described in, e.g., JP-A-60-185950 and JP-A-62-24252; couplers releasing a dye which turns to a colored form after being released described in EP 173,302A; bleaching accelerator releasing couplers described in, e.g., R.D. Nos. 11449 and 24241 and JP-A-61-201247; and a legand releasing coupler described in, e.g., U.S. Pat. No. 4,553,477.

The couplers for use in this invention can be introduced in the light-sensitive materials by various known dispersion methods.

Examples of a high-boiling solvent used in an oil-in-water dispersion method are described in, e.g., U.S. Pat. No. 2,322,027.

Examples of a high-boiling organic solvent to be used in the oil-in-water dispersion method and having a boiling point of 175° C. or more at normal pressure are phthalate esters (e.g., dibutylphthalate, dicyclohexylphthalate, and di-2-ethylhexylphthalate), phophates or phosphonates (e.g., triphenyl phosphate, tricresylphosphate, 2-ethylhexyldiphenylphosphate, tricyclohexylphosphate, and tri-2-ethylhexylphosphate), benzoates (e.g., 2-ethylhexylbenzoate, dodecylbenzoate, and 2-ethylhexyl-p-hydroxybenzoate), amides (e.g., N,N-diethyldodecaneamide, N,N-diethylaurylamide, and N-tetradecylpyrrolidone), alcohols or phenols (e.g., isostearylalcohol and 2,4-di-tert-amylphenol), aliphatic carboxylates (e.g., bis(2-ethylhexyl)sebacate, dioctylazelate, glyceroltributylate, isostearyllactate, and trioctylcitrate), an aniline derivative (e.g., N,N-dibutyl-2-butoxy-5-tert-octylaniline), and hydrocarbons (e.g., paraffin, dodecylbenzene, and diisopropylnaphthalene). An organic solvent having a boiling point of about 30° C. or more, and preferably, 50° C. to about 160° C. can be used as a co-solvent. Typical examples of the co-solvent are ethyl acetate, butyl acetate, ethyl propionate, methylethylketone, cyclohexanone, 2-ethoxyethylacetate, and dimethylformamide.

Steps and effects of a latex dispersion method and examples of an impregnating latex are described in, e.g., U.S. Pat. No. 4,199,363 and West German Patent Application (OLS) Nos. 2,541,274 and 2,541,230.

The present invention can be applied to various color light-sensitive materials. Examples of the material are a color negative film for a general purpose or a movie, a color reversal film for a slide or a television, color paper, a color positive film, and color reversal paper.

When the present invention is used as a material for color photographing, the present invention can be applied to light-sensitive materials having various structures and to light-sensitive materials having combinations of layer structures and special color materials.

Typical examples are: light-sensitive materials in which a coupling speed or diffusibility of a color coupler is combined with a layer structure, as disclosed in, e.g., JP-B-47-49031, JP-B-49-3843, JP-B-50-21248, JP-A-59-38147, JP-A-59-60437, JP-A-60-227256, JP-A-61-4043, JP-A-61-43743, and JP-A-61-42657; light-sensitive materials in which an identical color-sensitive layer is divided into two or more layers, as disclosed in JP-B-49-15495 and U.S. Pat. No. 3,843,469; and light-sensitive materials in which an arrangement of high- and low-speed layers or layers having different color sensitivities is defined, as disclosed in JP-B-53-37017, JP-B-53-37018, JP-A-51-49027, JP-A-52-143016, JP-A-53-97424, JP-A-53-97831, JP-A-62-200350, and JP-A-59-177551.

Examples of a support suitable for use in this invention are described in the above-mentioned RD. No. 17643, page 28 and ibid., No. 18716, page 647, right column to page 648, left column.

The color photographic light-sensitive materials according to this invention can be developed by the ordinary processes as described, for example, in the above-described Research Disclosure, No. 17643, pages 28 to 29 and ibid., No. 18716, page 651, left to right columns.

A color developer used in developing of the light-sensitive material of the present invention is, preferably, an aqueous alkaline solution containing as a main component an aromatic primary amine-based color developing agent. As the color developing agent, although an aminophenol-based compound is effective, a p-phenylenediamine-based compound is preferably used. Typical example of the p-phenylenediamine-based compound are 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylanline, 3-methyl-4-amino-N-ethyl-N-β-methoxyehtylaniline, and sulfates, hydrochlorides and p-toluenesulfonates thereof. These compounds can be used in a combination of two or more thereof in accordance with applications.

In general, the color developer contains a pH buffering agent such as a carbonate, a borate or a phosphate of an alkali metal, and a development restrainer or antifoggant such as a bromide, an iodide, a benzimidazole, a benzothiazole or a mercapto compound. If necessary, the color developer can also contain a preservative such as hydroxylamine, diehtylhydroxylamine, a hydrazine sulfite, a phenylsemicarbazide, triethanolamine, a catechol sulfonic acid or a triethylenediamine(1,4-diazabicyclo[2,2,2]octane); an organic solvent such as ethyleneglycol or diethyleneglycol; a development accelerator such as benzylalcohol, polyethyleneglycol, a quaternary ammonium salt or an amine; a dye forming coupler; a competing coupler; a fogging agent such as sodium boron hydride; an auxiliary developing agent such as 1-phenyl-3-pyrazolidone; a viscosity imparting agent; and a chelating agent such as an aminopolycarboxylic acid, an aminopolyphosphonic acid, an alkylphosphonic acid or a phosphonocarboxylic acid. Examples of the chelating agent are ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid and ethylenediamine-di(o-hydroxyphenylacetic acid), and salts thereof.

In order to perform reversal development, black-and-white development is performed and then color development is performed. As a black-and-white developer, well-known black-and-white developing agents, e.g., a dihydroxybenzene such as hydroquinone, a 3-pyrazolidone such as 1-phenyl-3-pyrazolidone, and an aminophenol such as N-methyl-p-aminophenol can be used singly or in a combination of two or more thereof.

The pH of the color developer and black-and-white developer is generally 9 to 12. Although a quantity of replenisher of the developer depends on a color photographic light-sensitive material to be processed, it is generally 3 liters or less per $m^2$ of the light-sensitive material. The quantity of replenisher can be decreased to be 500 ml or less by decreasing a bromide ion concentration in a replenisher. In order to decrease the quantity of replenisher, a contact area of a processing tank with air is preferably decreased to prevent evaporation and oxidation of the solution upon contact with air. The quantity of replenisher also can be decreased by using a means capable of suppressing an accumulation amount of bromide ions in the developer.

A color development time is normally set between 2 to 5 minutes. The processing time, however, can be shortened by setting a high temperature and a high pH and using the color developing agent at a high concentration.

The photographic emulsion layer is generally subjected to bleaching after color development. The bleaching can be performed either simultaneously with fixing (bleach-fix) or independently thereof. In addition, in order to increase a processing speed, bleach-fix can be performed after bleaching. Also, processing can be performed in a bleach-fix bath having two continuous tanks, fixing can be performed before bleach-fix, or bleaching can be performed after bleach-fix, in accordance with applications. Examples of the bleaching agent are a compound of a multivalent metal such as iron (III), cobalt (III), chromium (VI) and copper (II); a peroxide; a quinone; and a nitro compound. Typical examples of the bleaching agent are a ferricyanide; a bichromate; an organic complex salt of iron (III) or cobalt (III), e.g., a complex salt of an aminopolycarboxylic acid such as ethylenediamine tetraacetic acid, diethylenetriaminepentaacetic acid, cyclohexanediaminetetraacetic acid, methyliminodiacetic acid, and 1,3-diaminopropanetetraacetic acid, and glycoletherdiaminetetraacetic acid, or a complex salt of citric acid, tartaric acid or malic acid; a persulfate; a bromate; a permanganate; and a nitrobenzene. Of these compounds, an iron (III) complex salt of aminopoly-carboxylic acid such as an iron (III) complex salt of ethylenediaminetetraacetic acid, and a persulfate are preferred because they can increase the processing speed and prevent environmental contamination. The iron (III) complex salt of aminopolycarboxylic acid is effective in both the bleaching solution and bleach-fix bath. The pH of the bleaching solution or bleach-fix bath containing the iron (III) complex salt of aminopolycarboxylic acid is normally 5.5 to 8. In order to increase the processing speed, however, processing can be performed at a lower pH.

A bleaching accelerator can be used in the bleaching solution, the bleach-fix bath and their pre-bath, if necessary. Effective examples of the bleaching accelerator are described in, e.g., U.S. Pat. No. 3,893,858. A compound described in U.S. Pat. No. 4,552,834 is also preferable. These bleaching accelerators can be added in the light-sensitive material. These bleaching accelerators are effective especially in bleach-fix of a photographic color light-sensitive material.

Examples of the fixing agent are a thiosulfate, a thiocyanate, a thioether-based compound, a thiourea and a large amount of an iodide. Of these compounds, a thiosulfate, especially, ammonium thiosulfate can be used in a widest range of applications. As a preservative of the bleach-fix bath, a sulfite, a bisulfite or a carbonyl bisulfite adduct is preferred.

The photographic light-sensitive material of the present invention is normally subjected to washing and/or stabilizing steps after desilvering. An amount of water used in the washing step can be arbitrarily determined over a broad range in accordance with the properties of the light-sensitive material (e.g., a property determined by used material such as a coupler), the application of the light-sensitive material, the temperature of the washing water, the number of water tanks (the number of stages), a replenishing mode representing a counter or forward current, and other conditions. The relationship between the amount of water and the number of water tanks in a multi-stage counter-current mode can be obtained by a method described in "Journal of the Society of Motion Picture and Television Engineers", Vol. 64, PP. 248–253 (May, 1955).

According to the above-described multi-stage counter-current mode, the amount of water used for washing can be greatly decreased. Since washing water stays in the tanks for a long period of time, however, bacteria multiply and floating substances generated can be undesirably attached to the light-sensitive material. In order to solve this problem in the process of the color photographic light-sensitive material of the present invention, a method of decreasing calcium and magnesium ions can be quite effectively utilized, as described in JP-A-61-131632. In addition, a germicide such as an isothiazolone compound and cyabendazole described in JP-A-57-8542, a chlorine-based germicide such as chlorinated sodium isocyanurate, and germicides such as benzotriazole described in Hiroshi Horiguchi, "Chemistry of Antibacterial and Antifungal Agents", Eiseigijutsu-Kai ed., "Sterilization, Antibacterial, and Antifungal Techniques for Microorganisms", and Nippon Bokin Bobai Gakkai ed., "Cyclopedia of Antibacterial and Antifungal Agents".

The pH of the water for washing the photographic light-sensitive material of the present invention is 4 to 9, and preferably, 5 to 8. The water temperature and the washing time can vary in accordance with the properties and applications of the light-sensitive material. Normally, the washing time is 20 seconds to 10 minutes at a temperature of 15° C. to 45° C., and preferably, 30 seconds to 5 minutes at 25° C. to 40° C. The light-sensitive material of the present invention can be processed directly by a stabilizer without washing. All known methods described in JP-A-57-8543, JP-A-58-14834, and JP-A-60-220345 can be used in such stabilizing processing.

Stabilizing is sometimes performed subsequently to washing. An example is a stabilizing bath containing formation and a surface-active agent to be used as a final bath of the photographic color light-sensitive material. Various chelating agents or antifungal agents can be added also in the stabilizing bath.

An overflow solution produced upon washing and/or replenishment of the stabilizer can be reused in another step such as a desilvering step.

The silver halide color light-sensitive material according to the present invention can contain a color developing agent in order to simplify processing and increase a processing speed The silver halide color light-sensitive material according to the present invention can contain various 1-phenyl-3pyrazolidones in order to accelerate color development, if necessary. Typical examples of the compound are described in JP-A-56-64339, JP-A-57-144547, and JP-A-58-115438.

Each processing solution in the present invention is used at a temperature of 10° C. to 50° C. Although a normal processing temperature is 33° C. to 38° C., processing can be accelerated at a high temperature to shorten a processing time, or image quality or stability of a processing solution can be improved at a lower temperature. In order to save silver for the light-sensitive material, processing with cobalt intensification or hydrogen peroxide intensification described in West German Patent No. 2,226,770 or U.S. Pat. No. 3,674,499 can be performed.

The silver halide light-sensitive material of the present invention can also be applied to light-sensitive materials for thermal deveolpment described in, e.g., U.S. Pat. No. 4,500,626, JP-A-60-133449, JP-A-59-218443, JP-A-61-238056, and EP 210,660A2.

The present invention will be described in more detail below by way of its examples.

EXAMPLE 1

Double twined crystal grains comprising silver iodobromide and having an average iodide content of 20 mol % and an average sphere-equivalent diameter of 0.8 μm were used as seed crystals to form an emulsion in an aqueous gelatin solution by a controlled double jet method. The emulsion comprised twined crystal grains comprising silver iodobromide and having an average sphere-equivalent diameter of 1.2 μm, in which a core/shell ratio was 1:2 and a shell iodide content was 4 mol %.

After grain formation, the emulsion was subjected to a normal desalting/washing step and redispersed under the conditions of 40° C., a pAg of 8.9, and a pH of 6.1, thereby preparing an emulsion Em-A.

The emulsion Em-A was optimally gold-plus-sulfur-sensitized at 60° C. by using sodium thiosulfate and chloroauric acid to prepare an emulsion Em-1.

The emulsion Em-A was gold-plus-sulfur-sensitized following the same procedures as for the emulsion Em-1, and a nitrogen-containing heterocyclic compound (1) having a mercapto group listed in Table A to be presented later was added in amounts of $1\times10^{-6}$ mol and $1\times10^{-5}$ mol per mol of silver after gold-plus-sulfur sensitization, thereby preparing emulsions Em-2 and Em-3, respectively.

Sodium thiosulfate, chloroauric acid, and an ascorbic acid compound A-2 were added to the emulsion Em-A, and thus gold-plus-sulfur sensitization and reduction sensitization were performed to prepare emulsions Em-4 to Em-6.

Gold-plus-sulfur sensitization and reduction sensitization were performed following the same procedures as for the emulsions Em-4 to Em-6, and the nitrogen containing heterocyclic compound (1) having a mercapto group was added in amounts of $1\times10^{-6}$ mol and $1\times10^{-5}$ mol per mol of silver after reduction sensitization, thereby preparing emulsions Em-7 to Em-12.

Emulsions Em-13 to Em-36 listed in Tables 1-2 and 1-3 were prepared following the same procedures as for the emulsions Em-4 to Em-12 except that types of the ascorbic acid compound and the nitrogen-containing heterocyclic compound having a mercapto group were changed. Note that as for the emulsions Em-31 to Em-36, the nitrogen-containing heterocyclic compound having a mercapto group was added before the start of chemical sensitization.

Emulsion and protective layers in amounts as listed in Table 1-1 were coated on triacetylcellulose film supports having undercoating layers.

TABLE 1-1

| | |
|---|---|
| (1) Emulsion Layer | |
| Emulsion . . . emulsions Em-1 to Em-36 shown in Tables 1-2 to 1-3 | (silver $1.7\times10^{-2}$ mol/m$^2$) |
| Coupler | ($1.5\times10^{-3}$ mol/m$^2$) |

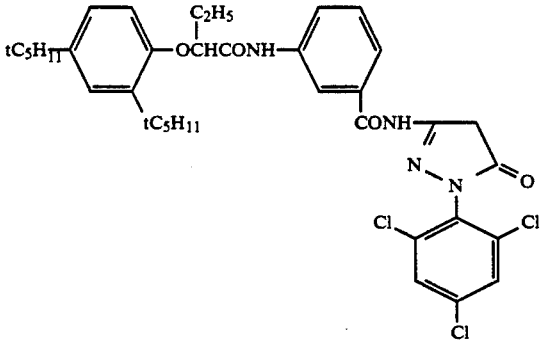

| | |
|---|---|
| Tricresylphosphate | (1.10 g/m$^2$) |
| Gelatin | (2.30 g/m$^2$) |
| (2) Protective Layer | |
| 2,4-dichlorotriazine-6-hydroxy-s-triazine sodium salt | (0.08 g/m$^2$) |
| Gelatin | (1.80 g/m$^2$) |

These samples were subjected to sensitometry exposure, and then to the following color development.

The processed samples were subjected to density measurement with a green filter. The results of obtained photographic properties are listed in Tables 1-2 and 1-3. The results are based on fog values and sensitivity values of the fresh properties of the emulsion Em-1. The fresh properties are an initial properties of a sample, which are measured immediately after preparation of the sample.

The same samples were stored at 60° C. and an RH of 30% for 3 days, and exposed and developed following the same procedures as described above, thereby measuring fog and sensitivity. The results are summarized in Tables 1-2 and 1-3.

Development was performed under the following conditions at a temperature of 38° C.

| | |
|---|---|
| 1. Color Development | 2 min. 45 sec. |
| 2. Bleaching | 6 min. 30 sec. |

-continued

| | |
|---|---|
| 3. Washing | 3 min. 15 sec. |
| 4. Fixing | 6 min. 30 sec. |
| 5. Washing | 3 min. 15 sec. |
| 6. Stabilizing | 3 min. 15 sec. |

The composition of processing solutions used in the above steps were as follows:

| | |
|---|---|
| Color Developer: | |
| Sodium Nitrilotriacetate | 1.4 g |
| Sodium Sulfite | 4.0 g |
| Sodium Carbonate | 30.0 g |
| Potassium Bromide | 1.4 g |
| Hydroxylamine Sulfate | 2.4 g |
| 4-(N-ethyl-N-β-hydroxyethylamino)-2-methyl-aniline Sulfate | 4.5 g |
| Water to make | 1 l |
| Bleaching Solution: | |
| Ammonium Bromide | 160.0 g |
| Ammonia Water (28%) | 25.0 ml |
| Sodium Ethylenediaminetetra-acetate | 130 g |
| Glacial Acetic Acid | 14 ml |
| Water to make | 1 l |
| Fixing Solution: | |
| Sodium Tetrapolyphosphate | 2.0 g |
| Sodium Sulfite | 4.0 g |
| Ammonium Thiosulfate (700 g/l) | 175.0 ml |
| Sodium Bisulfite | 4.6 g |
| Water to make | 1 l |
| Stabilizing Solution: | |
| Formalin | 8.0 ml |
| Water to make | 1 l |

In this case, normal wedge exposure was performed for 1/100 seconds.

A light source was adjusted at a color temperature of 4,800° K with a filter, and blue light was extracted with a blue filter (BPN42 (tradename): available from Fuji Photo Film Co. Ltd.). Sensitivities were compared at points each of which has an optical density higher than a fogging density by an optical density of (+)0.2.

As is apparent from Tables 1-2 and 1-3, each emulsion of the present invention had low fogging density, high sensitivity, and good storage stability.

TABLE 1-2

| Sample No. (Em No.) | Added Ascorbic Acid Compound | | Nitrogen-Containing Heterocyclic Compound Having Mercapto Group | | Fresh Properties | | After Storage/ 60° C. 30% RH 3 Days | | Remarks |
|---|---|---|---|---|---|---|---|---|---|
| | Compound | Amount (number of mols per mol of Ag) | Compound | Amount (number of mols per mol of Ag) | Fog | Relative Sensitivity | Fog | Relative Sensitivity | |
| 1 | — | — | — | — | ±0 (Reference of Fog) | 100 (Reference of Sensitivity | +0.20 | 76 | Comparative Example |
| 2 | — | — | (1) | $1 \times 10^{-6}$ | −0.01 | 95 | +0.10 | 87 | " |
| 3 | — | — | " | $1 \times 10^{-5}$ | −0.02 | 91 | +0.09 | 89 | " |
| 4 | A-1 | $5 \times 10^{-5}$ | — | — | +0.06 | 107 | +0.18 | 81 | " |
| 5 | " | $5 \times 10^{-4}$ | — | — | +0.08 | 112 | +0.20 | 79 | " |
| 6 | " | $5 \times 10^{-3}$ | — | — | +0.10 | 115 | +0.22 | 87 | " |
| 7 | " | $5 \times 10^{-5}$ | (1) | $1 \times 10^{-6}$ | ±0 | 132 | +0.03 | 129 | Present Invention |
| 8 | " | " | " | $1 \times 10^{-5}$ | " | 135 | +0.02 | 132 | " |
| 9 | A-1 | $5 \times 10^{-4}$ | (1) | $1 \times 10^{-6}$ | +0.01 | 141 | +0.03 | 141 | Present Invention |
| 10 | " | " | " | $1 \times 10^{-5}$ | " | 145 | +0.02 | 141 | " |
| 11 | " | $5 \times 10^{-3}$ | " | $1 \times 10^{-6}$ | " | 166 | +0.03 | 162 | " |
| 12 | " | " | " | $1 \times 10^{-5}$ | " | 166 | +0.02 | 162 | " |
| 13 | A-5 | $5 \times 10^{-5}$ | — | — | +0.06 | 105 | +0.17 | 79 | Comparative Example |
| 14 | " | $5 \times 10^{-4}$ | — | — | +0.08 | 112 | +0.18 | 81 | " |
| 15 | " | $5 \times 10^{-3}$ | — | — | +0.10 | 115 | +0.20 | 83 | " |
| 16 | " | $5 \times 10^{-5}$ | (19) | $1 \times 10^{-6}$ | +0.01 | 132 | +0.03 | 132 | Present Invention |
| 17 | " | " | " | $1 \times 10^{-5}$ | ±0 | 135 | +0.02 | 132 | " |

TABLE 1-3

| Sample No. (Em No.) | Added Ascorbic Acid Compound | | Nitrogen-Containing Heterocyclic Compound Having Mercapto Group | | Fresh Properties | | After Storage/ 60° C. 30% RH 3 Days | | Remarks |
|---|---|---|---|---|---|---|---|---|---|
| | Compound | Amount (number of mols per mol of Ag) | Compound | Amount (number of mols per mol of Ag) | Fog | Relative Sensitivity | Fog | Relative Sensitivity | |
| 18 | A-5 | $5 \times 10^{-4}$ | (19) | $1 \times 10^{-6}$ | +0.01 | 141 | +0.03 | 141 | Present Invention |
| 19 | " | " | " | $1 \times 10^{-5}$ | ±0 | 145 | +0.02 | 141 | " |
| 20 | " | $5 \times 10^{-3}$ | " | $1 \times 10^{-6}$ | +0.01 | 162 | +0.03 | 158 | " |
| 21 | " | " | " | $1 \times 10^{-5}$ | " | 162 | +0.02 | 158 | " |
| 22 | A-4 | $5 \times 10^{-5}$ | — | — | +0.07 | 105 | +0.16 | 76 | Comparative Example |
| 23 | " | $5 \times 10^{-4}$ | — | — | +0.08 | 107 | +0.18 | 83 | " |
| 24 | " | $5 \times 10^{-3}$ | — | — | +0.11 | 112 | +0.20 | 85 | " |
| 25 | " | $5 \times 10^{-5}$ | (30) | $1 \times 10^{-6}$ | +0.01 | 132 | +0.02 | 129 | Present Invention |
| 26 | " | " | " | $1 \times 10^{-5}$ | " | 136 | " | 132 | " |
| 27 | A-4 | $5 \times 10^{-4}$ | (30) | $1 \times 10^{-6}$ | +0.01 | 145 | +0.02 | 141 | Present Invention |
| 28 | " | " | " | $1 \times 10^{-5}$ | " | 145 | " | 141 | " |
| 29 | " | $5 \times 10^{-3}$ | " | $1 \times 10^{-6}$ | " | 170 | +0.03 | 166 | " |
| 30 | " | " | " | $1 \times 10^{-5}$ | " | 170 | " | 166 | " |
| 31 | A-5 | $5 \times 10^{-5}$ | (19) | $1 \times 10^{-6}$ | " | 136 | +0.02 | 132 | " |
| 32 | " | " | " | $1 \times 10^{-5}$ | " | 136 | " | 132 | " |
| 33 | " | $5 \times 10^{-4}$ | " | $1 \times 10^{-6}$ | " | 145 | " | 141 | " |
| 34 | " | " | " | $1 \times 10^{-5}$ | " | 148 | " | 145 | " |

TABLE 1-3-continued

| Sample No. (Em No.) | Added Ascorbic Acid Compound: Compound | Added Ascorbic Acid Compound: Amount (number of mols per mol of Ag) | Nitrogen-Containing Heterocyclic Compound Having Mercapto Group: Compound | Nitrogen-Containing Heterocyclic Compound Having Mercapto Group: Amount (number of mols per mol of Ag) | Fresh Properties: Fog | Fresh Properties: Relative Sensitivity | After Storage/ 60° C. 30% RH 3 Days: Fog | After Storage/ 60° C. 30% RH 3 Days: Relative Sensitivity | Remarks |
|---|---|---|---|---|---|---|---|---|---|
| 35 | " | $5 \times 10^{-3}$ | " | $1 \times 10^{-6}$ | " | 166 | +0.03 | 162 | " |
| 36 | " | " | " | $1 \times 10^{-5}$ | " | 170 | " | 166 | " |

EXAMPLE 2

The following dyes were added to the chemically sensitized emulsions prepared in Example 1 as shown in Table 2-1, thereby preparing spectrally sensitized emulsions.

The prepared emulsions were coated following the same procedures as in Example 1 and were subjected to a sensitometry test.

II

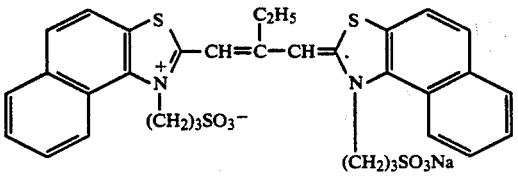

III

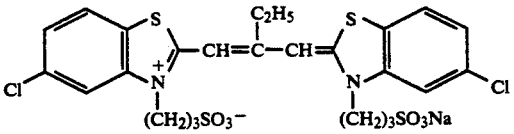

IV

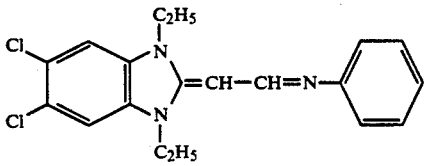

V

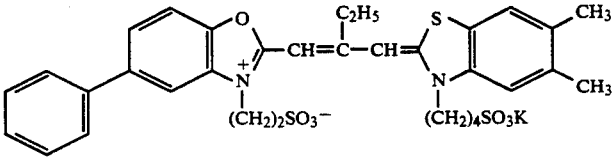

VI

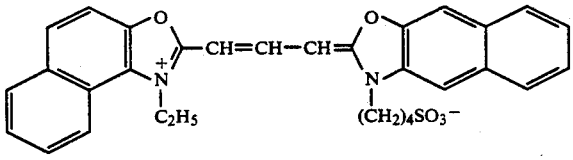

VII

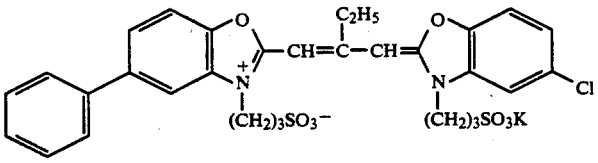

VIII

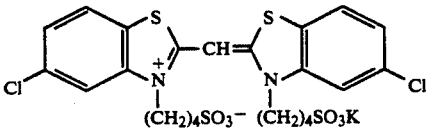

IX

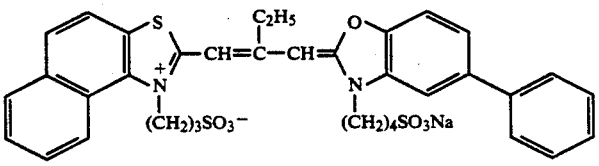

Dye Group 1 (Red-Sensitive Dye)

-continued

| | |
|---|---|
| Sensitizing Dye IX | $5.4 \times 10^{-5}$ mol/molAg |
| Sensitizing Dye II | $1.4 \times 10^{-5}$ mol/molAg |
| Sensitizing Dye III | $2.4 \times 10^{-4}$ mol/molAg |
| Sensitizing Dye IV | $3.1 \times 10^{-5}$ mol/molAg |
| Dye Group 2 (Green-Sensitive Dye) | |
| Sensitizing Dye V | $3.5 \times 10^{-5}$ mol/molAg |
| Sensitizing Dye VI | $8.0 \times 10^{-5}$ mol/molAg |
| Sensitizing Dye VII | $3.0 \times 10^{-4}$ mol/molAg |
| Dye Group 3 (Blue-Sensitive Dye) | |
| Sensitizing Dye VIII | $2.2 \times 10^{-4}$ mol/molAg |

The sensitometry test was performed following the same procedures as in Example 1 except that the emulsions added with the red- or green-sensitive dyes were exposed through a yellow filter (SC-52 (tradename): available from Fuji Photo Film Co. Ltd.) in place of the blue filter used in Example 1 and the emulsions added with the blue-sensitive dye were exposed without using a filter. Table 2-1 shows sensitivities of sample Nos. 204 to 206, 207 to 209, 210 to 212, 213 to 215, and 216 to 218 as relative sensitivities assuming that sensitivities of sample Nos. 201, 202, and 203 are 100 with respect to 1/100-sec exposures.

The same samples were stored at 60° C. and an RH of 30% for 3 days, and exposed and developed following the same procedures as described above, thereby measuring fog and sensitivity. The results are summarized in Table 2-1.

TABLE 2-1

| Sample No. (Em No.) | Emulsion | Dye Group | Fresh Properties Fog | Fresh Properties Relative Sensitivity | After Storage/60° C. 30% RH 3 Days Fog | After Storage/60° C. 30% RH 3 Days Relative Sensitivity | Remarks |
|---|---|---|---|---|---|---|---|
| 201 | Em-1 | 1 (Red-Sensitive Dye) | ±0 (Reference of Fog) | 100 (Reference of Sensitivity) | +0.11 | 85 | Comparative Example |
| 202 | " | 2 (Green-Sensitive Dye) | ±0 (Reference of Fog | 100 (Reference of Sensitivity) | +0.12 | 83 | " |
| 203 | " | 3 (Blue-Sensitive Dye) | ±0 (Reference of Fog) | 100 (Reference of Sensitivity) | " | 85 | " |
| 204 | Em-3 | 1 | −0.01 | 91 | +0.03 | 72 | " |
| 205 | " | 2 | " | 91 | " | 72 | " |
| 206 | " | 3 | " | 89 | +0.02 | 74 | " |
| 207 | Em-6 | 1 | +0.10 | 112 | +0.18 | 79 | " |
| 208 | " | 2 | " | 112 | " | 79 | " |
| 209 | " | 3 | " | 112 | +0.19 | 74 | " |
| 210 | Em-12 | 1 | +0.01 | 166 | +0.03 | 162 | Present Invention |
| 211 | " | 2 | " | 166 | " | 162 | " |
| 212 | " | 3 | +0.02 | 158 | +0.04 | 155 | " |
| 213 | Em-15 | 1 | +0.10 | 112 | +0.19 | 76 | Comparative Example |
| 214 | " | 2 | " | 112 | " | 78 | " |
| 215 | " | 3 | +0.11 | 115 | +0.16 | 78 | " |
| 216 | Em-21 | 1 | +0.02 | 166 | +0.03 | 158 | Present Invention |
| 217 | " | 2 | " | 166 | " | 162 | " |
| 218 | " | 3 | " | 166 | " | 162 | " |

As is apparent from Table 2-1, each emulsion of the present invention had high sensitivity, produced low fog, and had good storage stability.

EXAMPLE 3

A plurality of layers having the following compositions were coated on an undercoated triacetylcellulose film support to prepare sample 301 as a multilayer color light-sensitive material.

Light-Sensitive Layer Composition

Numerals corresponding to the respective components indicate coating amounts in units of g/m². A coating amount of silver halide is represented in unit of g/m² of silver. A coating amount of the sensitizing dye is represented in units of mols per mol of the silver halide in the same layer. Symbols representing additives have the following meanings. Note that if an additive has a plurality of effects, only one of the effects is shown.

| Sample 301 | |
|---|---|
| Layer 1: Antihalation Layer | |
| Black Colloidal Silver silver | 0.18 |
| Gelatin | 1.40 |
| Layer 2: Interlayer | |
| 2,5-di-t-pentadecylhydroquinone | 0.18 |
| EX-1 | 0.07 |
| EX-3 | 0.02 |
| EX-12 | 0.002 |
| U-1 | 0.06 |
| U-2 | 0.08 |
| U-3 | 0.10 |
| HBS-1 | 0.10 |
| HBS-2 | 0.02 |
| Gelatin | 1.04 |
| Layer 3: 1st Red-Sensitive Emulsion Layer | |
| Monodispersed Silver Iodobromide Emulsion (silver iodide = 6 mol %, average grain size = 0.6 μm, variation coefficient of grain size = 0.15) silver | 0.55 |
| Sensitizing Dye I | $6.9 \times 10^{-5}$ |
| Sensitizing Dye II | $1.8 \times 10^{-5}$ |
| Sensitizing Dye III | $3.1 \times 10^{-4}$ |
| Sensitizing Dye IV | $4.0 \times 10^{-5}$ |
| EX-2 | 0.350 |
| HBS-1 | 0.005 |
| EX-10 | 0.020 |
| Gelatin | 1.20 |
| Layer 4: 2nd Red-Sensitive Emulsion Layer | |
| Tabular Silver Iodobromide Emulsion (silver iodide = 10 mol %, average grain size = 0.7 μm, average aspect ratio = 5.5, average thickness = 0.2 μm) silver | 1.0 |
| Sensitizing Dye I | $5.1 \times 10^{-5}$ |
| Sensitizing Dye II | $1.4 \times 10^{-5}$ |
| Sensitizing Dye III | $2.3 \times 10^{-4}$ |
| Sensitizing Dye IV | $3.0 \times 10^{-5}$ |
| EX-2 | 0.400 |
| EX-3 | 0.050 |

-continued

| Sample 301 | |
|---|---|
| EX-10 | 0.015 |
| Gelatin | 1.30 |
| Layer 5: 3rd Red-Sensitive Emulsion Layer | |
| Silver Iodobromide Emulsion I silver | 1.60 |
| EX-3 | 0.240 |
| EX-4 | 0.120 |
| HBS-1 | 0.22 |
| HBS-2 | 0.10 |
| Gelatin | 1.63 |
| Layer 6: Interlayer | |
| EX-5 | 0.040 |
| HBS-1 | 0.020 |
| Gelatin | 0.80 |
| Layer 7: 1st Green-Sensitive Emulsion Layer | |
| Tabular Silver Iodobromide Emulsion (silver iodide = 6 mol %, average grain size = 0.6 μm, average aspect ratio = 6.0, average thickness = 0.15 μm) silver | 0.40 |
| Sensitizing Dye V | $3.0 \times 10^{-5}$ |
| Sensitizing Dye VI | $1.0 \times 10^{-4}$ |
| Sensitizing Dye VII | $3.8 \times 10^{-4}$ |
| EX-6 | 0.260 |
| EX-1 | 0.021 |
| EX-7 | 0.030 |
| EX-8 | 0.025 |
| HBS-1 | 0.100 |
| HBS-4 | 0.010 |
| Gelatin | 0.75 |
| Layer 8: 2nd Green-Sensitive Emulsion Layer | |
| Monodispersed Silver Iodobromide Emulsion (silver iodide = 9 mol %, average grain size = 0.7 μm, variation coefficient of grain size = 0.18) silver | 0.80 |
| Sensitizing Dye V | $2.1 \times 10^{-5}$ |
| Sensitizing Dye VI | $7.0 \times 10^{-5}$ |
| Sensitizing Dye VII | $2.6 \times 10^{-4}$ |
| EX-6 | 0.180 |
| EX-8 | 0.010 |
| EX-1 | 0.008 |
| EX-7 | 0.012 |
| HBS-1 | 0.160 |
| HBS-4 | 0.008 |
| Gelatin | 1.10 |
| Layer 9: 3rd Green-Sensitive Emulsion Layer | |
| Silver Iodobromide Emulsion II silver | 1.2 |
| EX-6 | 0.065 |
| EX-11 | 0.030 |
| EX-1 | 0.025 |
| HBS-1 | 0.25 |
| HBS-2 | 0.10 |
| Gelatin | 1.74 |
| Layer 10: Yellow Filter Layer | |
| Yellow Colloidal Silver silver | 0.05 |
| EX-5 | 0.08 |
| HBS-3 | 0.03 |
| Gelatin | 0.95 |
| Layer 11: 1st Blue-Sensitive Emulsion Layer | |
| Tabular Silver Iodobromide Emulsion (silver iodide = 6 mol %, average grain size = 0.6 μm, average aspect ratio = 5.7, average thickness = 0.15 μm) silver | 0.24 |
| Sensitizing Dye VIII | $3.5 \times 10^{-4}$ |
| EX-9 | 0.85 |
| EX-8 | 0.12 |
| HBS-1 | 0.28 |
| Gelatin | 1.28 |
| Layer 12: 2nd Blue-Sensitive Emulsion Layer | |
| Monodispersed Silver Iodobromide Emulsion (silver iodide = 10 mol %, average grain size = 0.8 μm, variation coefficient of grain size = 0.16) silver | 0.45 |
| Sensitizing Dye VIII | $2.1 \times 10^{-4}$ |
| EX-9 | 0.20 |
| EX-10 | 0.015 |
| HBS-1 | 0.03 |
| Gelatin | 0.46 |

-continued

| Sample 301 | |
|---|---|
| Layer 13: 3rd Blue-Sensitive Emulsion Layer | |
| Silver Iodobromide Emulsion III silver | 0.77 |
| EX-9 | 0.20 |
| HBS-1 | 0.07 |
| Gelatin | 0.69 |
| Layer 14: 1st Protective Layer | |
| Silver Iodobromide Emulsion (silver iodide = 1 mol %, average grain size = 0.07 μm) silver | 0.5 |
| U-4 | 0.11 |
| U-5 | 0.17 |
| HBS-1 | 0.90 |
| Gelatin | 1.00 |
| Layer 15: 2nd Protective Layer | |
| Polymethylacrylate Grains (diameter = about 1.5 μm) | 0.54 |
| S-1 | 0.15 |
| S-2 | 0.05 |
| Gelatin | 0.72 |

U: ultraviolet absorbent, HBS: high-boiling organic solvent, EX: coupler, S: additive.

In addition to the above components, a gelatin hardener H-1 and/or a surfactant were added to each layer. Formulas of the compounds which are used are listed in Table B.

Samples 302 to 306 were prepared following the same procedures as the sample 301 except that the silver iodobromide emulsions I, II, and III in the layers 5, 9, and 13, respectively, were changed as shown in Table 3-1(A).

These samples were subjected to sensitometry exposure and then to the following color development.

The processed samples were subjected to density measurement with red, green, and blue filters. The obtained results are shown in Table 3-1(B).

The same samples were stored at 60° C. and an RH of 30% for 3 days, and exposed and developed following the same procedures as described above, thereby measuring fog and sensitivity. The results are summarized in Table 3-1(B).

The results of photographic properties are represented by relative sensitivities of the red-, green-, and blue-sensitive layers assuming that the fresh sensitivities of each layers of the sample 301 is 100.

Processing Method

The color development process was performed at 38° C. in accordance with the following process steps.

| | |
|---|---|
| Color Development | 3 min. 15 sec. |
| Bleaching | 6 min. 30 sec. |
| Washing | 2 min. 10 sec. |
| Fixing | 4 min. 20 sec. |
| Washing | 3 min. 15 sec. |
| Stabilizing | 1 min. 05 sec. |

The compositions of processing solutions used in the respective steps were as follows.

| Color Developer | |
|---|---|
| Diethylenetriaminepentaacetic Acid | 1.0 g |
| 1-hydroxyethylidene-1,1-diphosphonic acid | 2.0 g |
| Sodium Sulfite | 4.0 g |
| Potassium Carbonate | 30.0 g |
| Potassium Bromide | 1.4 g |

-continued

| | |
|---|---|
| Potassium Iodide | 1.3 mg |
| Hydroxylamine Sulfate | 2.4 g |
| 4-(N-ethyl-N-β-hydroxyethylamino)-2-methylanilinesulfate | 4.5 g |
| Water to make | 1.0 l |
| pH | 10.0 |
| Bleaching Solution | |
| Ferric Ammonium Ethylenediaminetetraacetate | 100.0 g |
| Disodium Ethylenediaminetetraacetate | 10.0 g |
| Ammonium Bromide | 150.0 g |
| Ammonium Nitrate | 10.0 g |
| Water to make | 1.0 l |
| pH | 6.0 |
| Fixing Solution | |
| Disodium Ethylenediaminetetraacetate | 1.0 g |
| Sodium Sulfite | 4.0 g |
| Aqueous Ammonium Thiosulfate solution (70%) | 175.0 ml |
| Sodium Bisulfite | 4.6 g |
| Water to make | 1.0 l |
| pH | 6.6 |
| Stabilizing Solution | |
| Formalin (40%) | 2.0 ml |
| Polyoxyethylene-p-monononylphenylether (average polymerization degree = 10) | 0.3 g |
| Water to make | 1.0 l |

TABLE 3-1 (A)

| Sample | Layer 5 Silver Iodobromide Emulsion I | Layer 9 Silver Iodobromide Emulsion II | Layer 13 Silver Iodobromide Emulsion III |
|---|---|---|---|
| 301 (Comparative Example) | Example-2 Emulsion of Sample No. 201 | Emulsion of Sample No. 202 | Emulsion of Sample No. 203 |
| 302 (Comparative Example) | 204 | 205 | 206 |
| 303 (Comparative Example) | 207 | 208 | 209 |
| 304 (Present Invention) | 210 | 211 | 212 |
| 305 (Comparative Example) | 213 | 214 | 215 |
| 306 (Present Invention) | 216 | 217 | 218 |

TABLE 3-1 (B)

| Sample | Red-Sensitive Layer | | | | Green-Sensitive Layer | | | | Blue-Sensitive Layer | | | |
|---|---|---|---|---|---|---|---|---|---|---|---|---|
| | Fresh | | After Storage/ 60° C. 30% RH 3 Days | | Fresh | | After Storage/ 60° C. 30% RH 3 Days | | Fresh | | After Storage/ 60° C. 30% RH 3 Days | |
| | Fog | Relative Sensitivity | Fog | Relative Sensitivity | Fog | Relative Sensitivity | Fog | Relative Sensitivity | Fog | Relative Sensitivity | Fog | Relative Sensitivity |
| 301 (Comparative Example) | ±0 (Reference of Fog) | 100 (Reference of Sensitivity) | +0.10 | 84 | ±0 (Reference of Fog) | 100 (Reference of Sensitivity) | +0.11 | 82 | ±0 (Reference of Fog) | 100 (Reference of Sensitivity) | +0.13 | 82 |
| 302 (Comparative Example) | −0.01 | 91 | +0.03 | 72 | −0.01 | 89 | +0.02 | 74 | −0.01 | 91 | +0.03 | 72 |
| 303 (Comparative Example) | +0.09 | 115 | +0.18 | 78 | +0.08 | 115 | +0.20 | 78 | +0.09 | 112 | +0.19 | 74 |
| 304 (Present Invention) | +0.01 | 166 | +0.03 | 162 | +0.01 | 162 | +0.03 | 162 | +0.01 | 166 | +0.03 | 162 |
| 305 (Comparative Example) | +0.08 | 112 | +0.21 | 79 | +0.10 | 117 | +0.21 | 76 | +0.09 | 115 | +0.20 | 78 |
| 306 (Present Invention) | +0.01 | 162 | +0.03 | 158 | +0.01 | 158 | +0.03 | 155 | +0.02 | 66 | +0.03 | 162 |

As is apparent from Table 3-1(A) and 3-1(B), the emulsions of the present invention had high sensitivity, produced low fog, and had good storage stability.

EXAMPLE 4

The samples 301 to 306 of Example 3 were exposed following the same procedures as in Example 3 and processed as follows by using an automatic developing machine.

Processing Method

| Step | Time | Temperature |
|---|---|---|
| Color Development | 3 min. 15 sec. | 38° C. |
| Bleaching | 1 min. 00 sec. | 38° C. |
| Bleach-Fix | 3 min. 15 sec. | 38° C. |
| Washing (1) | 40 sec. | 35° C. |
| Washing (2) | 1 min. 00 sec. | 35° C. |
| Stabilizing | 40 sec. | 38° C. |
| Drying | 1 min. 15 sec. | 55° C. |

The compositions of the processing solutions will be described below.

| | (g) |
|---|---|
| Color Developer | |
| Diethylenetriaminepentaacetic Acid | 1.0 |
| 1-hydroxyethylidene-1,1-diphosphonic Acid | 3.0 |
| Sodium Sulfite | 4.0 |
| Potassium Carbonate | 30.0 |
| Potassium Bromide | 1.4 |
| Potassium Iodide | 1.5 mg |
| Hydroxylamine Sulfate | 2.4 |
| 4-[N-ethyl-N-(β-hydroxyethyl)amino]-2-methylaniline Sulfate | 4.5 |
| Water to make | 1.0 l |
| pH | 10.05 |
| Bleaching Solution | |
| Ferric Ammonium Ethylenediaminetetraacetate Dihydrate | 120.0 |
| Disodium Ethylenediaminetetraacetate | 10.0 |
| Ammonium Bromide | 100.0 |
| Ammonium Nitrate | 10.0 |
| Bleaching Accelerator | 0.005 mol |
| $(CH_3)_2N-CH_2-CH_2-S-S-CH_2-CH_2-N(CH_3)_2$ | |
| Ammonia Water (27%) | 15.0 ml |
| Water to make | 1.0 l |
| pH | 6.3 |
| Bleach-Fix bath | |
| Ferric Ammonium Ethylenediaminetetraacetate Dihydrate | 50.0 |
| Disodium Ethylenediaminetetraacetate | 5.0 |
| Sodium Sulfite | 12.0 |
| Aqueous Ammonium Thiosulfate Solution (70%) | 240.0 ml |
| Ammonia Water (27%) | 6.0 ml |
| Water to make | 1.0 l |
| pH | 7.2 |
| Washing Solution | |
| Tap water was supplied to a mixed-bed column filled with an H type strongly acidic cation exchange resin (Amberlite IR-120B: available from Rohm & Haas Co.) and an OH type basic anion exchange resin (Amberlite IR-400) to set the concentrations of calcium and magnesium ion to be 3 mg/l or less. Subsequently, 20 mg/l of sodium isocyanuric acid dichloride and 0.15 g/l of sodium sulfate were added. The pH of the solution fell within the range of 6.5 to 7.5. | |
| Stabilizing Solution | |
| Formalin (37%) | 2.0 ml |
| Polyoxyethylene-p-monononylphenylether (average polymerization degree = 10) | 0.3 |
| Disodium Ethylenediaminetetraacetate | 0.05 |
| Water to make | 1.0 l |
| pH | 5.0 to 8.0 |

The samples 304 and 306 of the present invention provided the good results as in Example 3 after they were subjected to the above processing.

EXAMPLE 5

The samples 301 to 306 of Example 3 were exposed following the same procedures as in Example 3 and processed as follows by using an automatic developing machine.

Processing Method

| Step | Time | Temperature |
|---|---|---|
| Color development | 2 min. 30 sec. | 40° C. |
| Bleach-Fix | 3 min. 00 sec. | 40° C. |
| Washing (1) | 20 sec. | 35° C. |
| Washing (2) | 20 sec. | 35° C. |
| Stabilizing | 20 sec. | 35° C. |
| Drying | 50 sec. | 65° C. |

The compositions of the processing solutions will be described below.

| | (g) |
|---|---|
| Color Developer | |
| Diethylenetriaminepentaacetic Acid | 2.0 |
| 1-hydroxyethylidene-1,1-diphosphonic Acid | 3.0 |
| Sodium Sulfite | 4.0 |
| Potassium Carbonate | 30.0 |
| Potassium Bromide | 1.4 |
| Potassium Iodide | 1.5 mg |
| Hydroxylamine Sulfate | 2.4 |
| 4-[N-ethyl-N-(β-hydroxyethyl)amino]-2-methylaniline Sulfate | 4.5 |
| Water to make | 1.0 l |
| pH | 10.05 |
| Bleach-Fix bath | |
| Ferric Ammonium Ethylenediaminetetraacetate Dihydrate | 50.0 |
| Disodium Ethylenediaminetetraacetate | 5.0 |
| Sodium Sulfite | 12.0 |
| Aqueous Ammonium Thiosulfate Solution (70%) | 260.0 ml |
| Acetic Acid (98%) | 5.0 ml |
| Bleaching Accelerator | 0.01 mol |
| 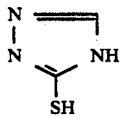 | |
| Water to make | 1.0 l |
| pH | 6.0 |
| Washing Solution | |
| Tap water was supplied to a mixed-bed column filled with an H type strongly acidic cation exchange resin (Amberlite IR-120B: available from Rohm & Haas Co.) and an OH type basic anion exchange resin (Amberlite IR-400) to set the concentrations of calcium and magnesium ion to be 3 mg/l or less. Subsequently, 20 mg/l of sodium isocyanuric acid dichloride and 0.15 g/l of sodium sulfate were added. The pH of the solution fell within the range of 6.5 to 7.5. | |
| Stabilizing Solution | |
| Formalin (37%) | 2.0 ml |
| Polyoxyethylene-p-monononylphenylether (average polymerization degree = 10) | 0.3 |
| Disodium Ethylenediaminetetraacetate | 0.05 |
| Water to make | 1.0 l |
| pH | 5.0 to 8.0 |

The samples 304 and 306 of the present invention provided the good results as in Example 3 after they were subjected to the above processing.

EXAMPLE 6

A plurality of layers having the following compositions were coated on an undercoated cellulose triacetate film support to prepare a sample 401 as a multilayered color light-sensitive material.

Compositions of Light-Sensitive Layers

The amounts are represented in units of g/m$^2$. The coated amounts of silver halide and colloidal silver are represented in units of g/m$^2$ of silver, and that of sensitizing dyes is represented by the number of mols per mol of the silver halide in the same layer. Symbols representing additives have the following meanings.

Note that if an additive has a plurality of effects, only one of the effects is shown.

| | |
|---|---|
| Layer 1: Antihalation Layer | |
| Black Colloidal Silver coated silver amount | 0.2 |
| Gelatin | 2.2 |
| UV-1 | 0.1 |
| UV-2 | 0.2 |
| Cpd-1 | 0.05 |
| Solv-1 | 0.01 |
| Solv-2 | 0.01 |
| Solv-3 | 0.08 |
| Layer 2: Interlayer | |
| Fine Silver Bromide Grain (sphere-equivalent diameter = 0.07 μm) coated silver amount | 0.15 |
| Gelatin | 1.0 |
| Cpd-2 | 0.2 |
| Layer 3: 1st Red-Sensitive emulsion Layer | |
| Silver Iodobromide Emulsion (AgI = 10.0 mol %, internally high AgI type, sphere-equivalent diameter = 0.7 μm, variation coefficient of sphere-equivalent diameter = 14%, tetradecahedral grain) coated silver amount | 0.26 |
| Silver Iodobromide Emulsion (AgI = 4.0 mol %, internally high AgI type, sphere-equivalent diameter = 0.4 μm, variation coefficient of sphere-equivalent diameter = 22%, coated silver amount | 0.2 |
| Gelatin | 1.0 |
| EXS-1 | $4.5 \times 10^{-4}$ |
| EXS-2 | $1.5 \times 10^{-4}$ |
| EXS-3 | $0.4 \times 10^{-4}$ |
| ExS-4 | $0.3 \times 10^{-4}$ |
| ExC-1 | 0.33 |
| ExC-2 | 0.009 |
| ExC-3 | 0.023 |
| ExC-6 | 0.14 |
| Layer 4: 2nd Red-Sensitive Emulsion Layer | |
| Silver Iodobromide Emulsion (AgI = 16 mol %, internally high AgI type, sphere-equivalent diameter = 1.0 μm, variation coefficient of sphere-equivalent diameter = 25%, tabular grain, diameter/thickness ratio = 4.0) coated silver amount | 0.55 |
| Gelatin | 0.7 |
| ExS-1 | $3 \times 10^{-4}$ |
| ExS-2 | $1 \times 10^{-4}$ |
| ExS-3 | $0.3 \times 10^{-4}$ |
| ExS-4 | $0.3 \times 10^{-4}$ |
| ExC-3 | 0.05 |
| ExC-4 | 0.10 |
| ExC-6 | 0.08 |
| Layer 5: 3rd Red-Sensitive Emulsion Layer | |
| Silver Iodobromide Emulsion I (internally high AgI type, sphere-equivalent diameter = 1.2 μm, variation coefficient of sphere-equivalent diameter = 28%) coated silver amount | 0.9 |
| Gelatin | 0.6 |
| ExS-1 | $2 \times 10^{-4}$ |
| EXS-2 | $0.6 \times 10^{-4}$ |
| EXS-3 | $0.2 \times 10^{-4}$ |
| ExC-4 | 0.07 |
| ExC-5 | 0.06 |
| Solv-1 | 0.12 |
| Solv-2 | 0.12 |
| Layer 6: Interlayer | |
| Gelatin | 1.0 |
| Cpd-4 | 0.1 |
| Layer 7: 1st Green-Sensitive Emulsion Layer | |
| Silver Iodobromide Emulsion (AgI = 10.0 mol %, internally high AgI type, sphere-equivalent diameter = 0.7 μm, variation coefficient of sphere-equivalent diameter = 14%, tetra-decahedral grain) coated silver amount | 0.2 |
| Silver Iodobromide Emulsion (AgI = 4.0 mol %, internally high AgI type, sphere-equivalent diameter = 0.4 μm, variation coefficient of sphere-equivalent diameter = 22%, tetra-decahedral grain) coated silver amount | 0.1 |
| Gelatin | 1.2 |
| ExS-5 | $5 \times 10^{-4}$ |
| ExS-6 | $2 \times 10^{-4}$ |
| ExS-7 | $1 \times 10^{-4}$ |
| ExM-1 | 0.41 |
| ExM-2 | 0.10 |
| ExM-5 | 0.03 |
| Solv-1 | 0.2 |
| Solv-5 | 0.03 |
| Layer 8: 2nd Green-Sensitive Emulsion Layer | |
| Silver Iodobromide Emulsion (AgI = 10 mol %, internally high iodide type, sphere-equivalent diameter = 1.0 μm, variation coefficient of sphere-equivalent diameter = 25%, tabular grain, diameter/thickness ratio = 3.0) coated silver amount | 0.4 |
| Gelatin | 0.35 |
| ExS-5 | $3.5 \times 10^{-4}$ |
| ExS-6 | $1.4 \times 10^{-4}$ |
| ExS-7 | $0.7 \times 10^{-4}$ |
| ExM-1 | 0.09 |
| ExM-3 | 0.01 |
| Solv-1 | 0.15 |
| Solv-5 | 0.03 |
| Layer 9: Interlayer | |
| Gelatin | 0.5 |
| Layer 10: 3rd Green-Sensitive Emulsion Layer | |
| Silver Iodobromide emulsion II (internally high AgI type, sphere-equivalent diameter = 1.2 μm, variation coefficient of sphere-equivalent diameter = 28%) coated silver amount | 1.0 |
| Gelatin | 0.8 |
| ExS-5 | $2 \times 10^{-4}$ |
| ExS-6 | $0.8 \times 10^{-4}$ |
| ExS-7 | $0.8 \times 10^{-4}$ |
| ExM-3 | 0.01 |
| ExM-4 | 0.04 |
| ExC-4 | 0.005 |
| Solv-1 | 0.2 |
| Layer 11: Yellow Filter Layer | |
| Cpd-3 | 0.05 |
| Gelatin | 0.5 |
| Solv-1 | 0.1 |
| Layer 12: Interlayer | |
| Gelatin | 0.5 |
| Cpd-2 | 0.1 |
| Layer 13: 1st Blue-Sensitive Emulsion Layer | |
| Silver Iodobromide Emulsion (AgI = 10 mol %, internally high iodide type, sphere-equivalent diameter = 0.7 μm, variation coefficient of sphere-equivalent diameter = 14%, tetra-decahedral grain) coated silver amount | 0.1 |
| Silver Iodobromide Emulsion (AgI = 4.0 mol %, internally high iodide type, sphere-equivalent diameter = 0.4 μm, variation coefficient of sphere-equivalent diameter = 22%, tetra-decahedral grain) coated silver amount | 0.05 |
| Gelatin | 1.0 |
| ExS-8 | $3 \times 10^{-4}$ |
| ExY-1 | 0.53 |
| ExY-2 | 0.02 |
| Solv-1 | 0.15 |
| Layer 14: 2nd Blue-Sensitive Emulsion Layer | |
| Silver Iodobromide Emulsion (AgI = 19.0 mol %, internally high AgI type, sphere-equivalent diameter = 1.0 μm, variation coefficient of sphere-equivalent diameter = 16%, tetra-decahedral grain) coated silver amount | 0.19 |
| Gelatin | 0.3 |
| ExS-8 | $2 \times 10^{-4}$ |

-continued

| | |
|---|---|
| ExY-1 | 0.22 |
| Solv-1 | 0.07 |
| Layer 15: Interlayer | |
| Fine Silver Iodobromide Grain (AgI = 2 mol %, homogeneous type, sphere-equivalent diameter = 0.13 μm) coated silver amount | 0.2 |
| Gelatin | 0.36 |
| Layer 16: 3rd Blue-Sensitive Emulsion Layer | |
| Silver Iodobromide Emulsion III (internally high AgI type, sphere-equivalent diameter = 1.2 μm, variation coefficient of sphere-equivalent diameter = 28%) coated silver amount | 1.0 |
| Gelatin | 0.5 |
| ExS-8 | $1.5 \times 10^{-4}$ |
| ExY-1 | 0.2 |
| Solv-4 | 0.07 |
| Layer 17: 1st Protective Layer | |
| Gelatin | 1.8 |
| UV-1 | 0.1 |
| UV-2 | 0.2 |
| Solv-1 | 0.01 |
| Solv-2 | 0.01 |
| Layer 18: 2nd Protective Layer | |
| Fine Silver Bromide Grain (sphere-equivalent diameter = 0.07 μm) coating silver amount | 0.18 |
| Gelatin | 0.7 |
| Polymethylmethacrylate Grain (diameter = 1.5 μm) | 0.2 |
| W-1 | 0.02 |
| H-1 | 0.4 |
| Cpd-5 | 1.0 |

UV: ultraviolet absorbent, Solv: high-boiling organic solvent, W: coating aid, H: film hardener, ExS: sensitizing dye, ExC: cyan coupler, ExM: magenta coupler, ExY: yellow coupler, Cpd: additive.

Formulas of the compounds which are used are listed in Table C.

Samples 402 and 406 were prepared following the same procedures as for the above sample 401 except that the silver iodobromide emulsions I, II, and III in the layers 5, 10, and 16, respectively, were changed as shown in Table 4-1(A).

These samples were subjected to sensitometry exposure and, then, to color development following the same procedures as in Example 3.

The processed samples were subjected to density measurement with red, green, and blue filters. The obtained results are shown in the column of "Fresh" of Table 4-1(B).

The same samples were stored at 60° C. and an RH of 30% for 3 days, and exposed and developed following the same procedures as described above, thereby measuring fog and sensitivity. The results are summarized in the column of "After Storage 160° C. 30%RH 3 Days" of Table 4-1(B).

The results of photographic properties are represented by relative sensitivities of the red-, green-, and blue-sensitive layers assuming that the fresh sensitivity of the sample 401 is 100.

As is apparent from Tables 4-1(A) and 4-1(B), the emulsions of the present invention had high sensitivity, produced low fog, and had good storage stability.

TABLE 4-1 (A)

| Sample | Layer 5 Silver Iodobromide Emulsion I | Layer 10 Silver Iodobromide Emulsion II | Layer 16 Silver Iodobromide Emulsion III |
|---|---|---|---|
| 401 (Comparative Example) | Example-2 Emulsion of Sample No. 201 | Emulsion of Sample No. 202 | Emulsion of Sample No. 203 |
| 402 (Comparative Example) | 204 | 205 | 206 |
| 403 (Comparative Example) | 207 | 208 | 209 |
| 404 (Present Invention) | 210 | 211 | 212 |
| 405 (Comparative Example) | 213 | 214 | 215 |
| 406 (Present Invention) | 216 | 217 | 218 |

TABLE 4-1 (B)

| | Red-Sensitive Layer | | | | Green-Sensitive Layer | | | | Blue-Sensitive Layer | | | |
|---|---|---|---|---|---|---|---|---|---|---|---|---|
| | Fresh | | After Storage/ 60° C. 30% RH 3 Days | | Fresh | | After Storage/ 60° C. 30% RH 3 Days | | Fresh | | After Storage/ 60° C. 30% RH 3 Days | |
| Sample | Fog | Relative Sensitivity | Fog | Relative Sensitivity | Fog | Relative Sensitivity | Fog | Relative Sensitivity | Fog | Relative Sensitivity | Fog | Relative Sensitivity |
| 401 (Comparative Example) | ±0 (Reference of Fog) | 100 (Reference of Sensitivity) | +0.12 | 81 | +0 (Reference of Fog) | 100 (Reference of Sensitivity) | +0.11 | 79 | +0 (Reference of Fog) | 100 (Reference of Sensitivity) | +0.11 | 79 |
| 402 (Comparative Example) | −0.01 | 91 | +0.03 | 74 | −0.01 | 89 | +0.02 | 72 | −0.01 | 91 | +0.03 | 76 |
| 403 (Comparative Example) | +0.09 | 117 | +0.18 | 76 | +0.02 | 115 | +0.20 | 81 | +0.11 | 110 | +0.19 | 72 |
| 404 (Present Invention) | +0.01 | 166 | +0.03 | 162 | +0.01 | 162 | +0.03 | 162 | +0.01 | 162 | +0.03 | 162 |
| 405 (Comparative Example) | +0.10 | 115 | +0.21 | 78 | +0.03 | 112 | +0.21 | 79 | +0.10 | 107 | +0.20 | 78 |
| 406 (Present | +0.01 | 162 | +0.03 | 158 | +0.01 | 166 | +0.03 | 158 | +0.02 | 166 | +0.03 | 162 |

TABLE 4-1 (B)-continued

| | Red-Sensitive Layer | | | | Green-Sensitive Layer | | | | Blue-Sensitive Layer | | | |
|---|---|---|---|---|---|---|---|---|---|---|---|---|
| | Fresh | | After Storage/ 60° C. 30% RH 3 Days | | Fresh | | After Storage/ 60° C. 30% RH 3 Days | | Fresh | | After Storage/ 60° C. 30% RH 3 Days | |
| Sample | Fog | Relative Sensitivity | Fog | Relative Sensitivity | Fog | Relative Sensitivity | Fog | Relative Sensitivity | Fog | Relative Sensitivity | Fog | Relative Sensitivity |
| Invention) | | | | | | | | | | | | |

EXAMPLE 7

A plurality of layers having the following compositions were coated on an undercoated triacetylcellulose film support to prepare a sample 501 as a multilayered color light-sensitive material.

Compositions of Light-Sensitive Layers

The coated amount of a silver halide and colloidal silver are represented in units of g/m$^2$ of silver, that of couplers, additives, and gelatin is represented in units of g/m$^2$, and that of sensitizing dye is represented by the number of mols per mol of the silver halide in the same layer. Symbols representing additives have the following meanings. Note that if an additive has a plurality of effects, only one of the effects is shown.

| | |
|---|---|
| Layer 1: Antihalation Layer | |
| Black Colloidal Silver | 0.15 |
| Gelatin | 2.9 |
| UV-1 | 0.03 |
| UV-2 | 0.06 |
| UV-3 | 0.07 |
| Solv-2 | 0.08 |
| ExF-1 | 0.01 |
| ExF-2 | 0.01 |
| Layer 2: Low-Speed Red-Sensitive Emulsion Layer | |
| Silver Iodobromide Emulsion (AgI = 4 mol %, homogeneous type, sphere-equivalent diameter = 0.4 μm, variation coefficient of sphere-equivalent diameter = 37%, tabular grain, diameter/thickness ratio = 3.0) coated silver amount | 0.4 |
| Gelatin | 0.8 |
| ExS-1 | $2.3 \times 10^{-4}$ |
| ExS-2 | $1.4 \times 10^{-4}$ |
| ExS-5 | $2.3 \times 10^{-4}$ |
| ExS-7 | $8.0 \times 10^{-6}$ |
| ExC-1 | 0.17 |
| ExC-2 | 0.03 |
| ExC-3 | 0.13 |
| Layer 3: Intermediate-Speed Red-Sensitive Emulsion Layer | |
| Silver Iodobromide Emulsion (AgI = 6 mol %, internally high AgI type having core/shell ratio of 2:1, sphere-equivalent diameter = 0.65 μm, variation coefficient of sphere-equivalent diameter = 25%, tabular grains, diameter/thickness ratio = 2.0) coated silver amount | 0.65 |
| Silver Iodobromide Emulsion (AgI = 4 mol %, homogeneous AgI type, sphere-equivalent diameter = 0.4 μm, variation coefficient of sphere-equivalent diameter = 37%, tabular grain, diameter/thickness ratio = 3.0) coated silver amount | 0.1 |
| Gelatin | 1.0 |
| ExS-1 | $2 \times 10^{-4}$ |
| ExS-2 | $1.2 \times 10^{-4}$ |
| ExS-5 | $2 \times 10^{-4}$ |
| ExS-7 | $7 \times 10^{-6}$ |
| ExC-1 | 0.31 |
| ExC-2 | 0.01 |
| ExC-3 | 0.06 |

-continued

| | |
|---|---|
| Layer 4: High-Speed Red-Sensitivity Emulsion Layer | |
| Silver Iodobromide Emulsion I (internally high AgI type having core/shell ratio of 1:2, sphere-equivalent diameter = 0.75 μm, variation coefficient of sphere-equivalent diameter = 25%) coated silver amount | 0.9 |
| Gelatin | 0.8 |
| ExS-1 | $1.6 \times 10^{-4}$ |
| ExS-2 | $1.6 \times 10^{-4}$ |
| ExS-5 | $1.6 \times 10^{-4}$ |
| ExS-7 | $6 \times 10^{-4}$ |
| ExC-1 | 0.07 |
| ExC-4 | 0.05 |
| Solv-1 | 0.07 |
| Solv-2 | 0.20 |
| Cpd-7 | $4.6 \times 10^{-4}$ |
| Layer 5: Interlayer | |
| Gelatin | 0.6 |
| UV-4 | 0.03 |
| UV-5 | 0.04 |
| Cpd-1 | 0.1 |
| Polyethylacrylate Latex | 0.08 |
| Solv-1 | 0.05 |
| Layer 6: Low-Speed Green-Sensitive Emulsion Layer | |
| Silver Iodobromide Emulsion (AgI = 4 mol %, homogeneous type, sphere-equivalent diameter = 0.7 μm, variation coefficient of sphere equivalent diameter = 37%, tabular grain, diameter/thickness ratio = 2.0) coated silver amount | 0.18 |
| Gelatin | 0.4 |
| ExS-3 | $2 \times 10^{-4}$ |
| ExS-4 | $7 \times 10^{-4}$ |
| ExS-5 | $1 \times 10^{-4}$ |
| EXM-5 | 0.11 |
| ExM-7 | 0.03 |
| ExY-8 | 0.01 |
| Solv-1 | 0.09 |
| Solv-4 | 0.01 |
| Layer 7: Intermediate-Speed Green-Sensitive Emulsion Layer | |
| Silver Iodobromide Emulsion (AgI = 4 mol %, surface high AgI type having core/shell ratio of 1:1, sphere-equivalent diameter = 0.5 μm, variation coefficient of sphere-equivalent diameter = 20%, tabular grain, diameter/thickness ratio = 4.0) coated silver amount | 0.27 |
| Gelatin | 0.6 |
| ExS-3 | $2 \times 10^{-4}$ |
| ExS-4 | $7 \times 10^{-4}$ |
| ExS-5 | $1 \times 10^{-4}$ |
| ExM-5 | 0.17 |
| ExM-7 | 0.04 |
| ExY-8 | 0.02 |
| Solv-1 | 0.14 |
| Solv-4 | 0.02 |
| Layer 8: High-Speed Green-Sensitive Emulsion Layer | |
| Silver Iodobromide Emulsion II (internally high AgI type having core/shell ratio of 1:2, sphere-equivalent diameter = 0.75 μm, variation coefficient of sphere-equivalent diameter = 25%) coated silver amount | 0.7 |

-continued

| | |
|---|---|
| Gelatin | 0.8 |
| ExS-4 | $5.2 \times 10^{-4}$ |
| ExS-5 | $1 \times 10^{-4}$ |
| ExS-8 | $0.3 \times 10^{-4}$ |
| ExM-5 | 0.1 |
| ExM-6 | 0.03 |
| ExY-8 | 0.02 |
| ExC-1 | 0.02 |
| ExC-4 | 0.01 |
| Solv-1 | 0.25 |
| Solv-2 | 0.06 |
| Solv-4 | 0.01 |
| Cpd-7 | $1 \times 10^{-4}$ |
| Layer 9: Interlayer | |
| Gelatin | 0.6 |
| Cpd-1 | 0.04 |
| Polyethylacrylate Latex | 0.12 |
| Solv-1 | 0.02 |
| Layer 10: Donor Layer having Interlayer Effect on Red-Sensitive Layer | |
| Silver Iodobromide Emulsion (AgI = 6 mol %, internally high AgI type having core/shell ratio of 2:1, sphere-equivalent diameter = 0.7 μm, variation coefficient of sphere-equivalent diameter = 25%, tabular grain, diameter/thickness ratio = 2.0) coated silver amount | 0.68 |
| Silver Iodobromide Emulsion (AgI = 4 mol %, homogeneous type, variation coefficient of sphere-equivalent diameter = 37%, tabular grain, diameter/thickness ratio = 3.0) coated silver amount | 0.19 |
| Gelatin | 1.0 |
| ExS-3 | $6 \times 10^{-4}$ |
| ExM-10 | 0.19 |
| Solv-1 | 0.20 |
| Layer 11: Yellow Filter Layer | |
| Yellow Colloidal Silver | 0.06 |
| Gelatin | 0.8 |
| Cpd-2 | 0.13 |
| Solv-1 | 0.13 |
| Cpd-1 | 0.07 |
| Cpd-6 | 0.002 |
| H-1 | 0.13 |
| Layer 12: Low-Speed Blue-Sensitive Emulsion Layer | |
| Silver Iodobromide Emulsion (AgI = 4.5 mol %, homogeneous AgI type, sphere-equivalent diameter = 0.7 μm, variation coefficient of sphere-equivalent diameter = 15%, tabular grain, diameter/thickness ratio = 7.0) coated silver amount | 0.3 |
| Silver Iodobromide Emulsion (AgI = 3 mol %, homogeneous AgI type, sphere-equivalent diameter = 0.3 μm, variation coefficient of sphere-equivalent diameter = 30%, tabular grain, diameter/thickness ratio = 7.0) coated silver amount | 0.15 |
| Gelatin | 1.8 |
| ExS-6 | $9 \times 10^{-4}$ |
| ExC-1 | 0.06 |
| ExC-4 | 0.03 |
| ExY-9 | 0.14 |
| ExY-11 | 0.89 |
| Solv-1 | 0.42 |
| Layer 13: Interlayer | |
| Gelatin | 0.7 |
| ExY-12 | 0.20 |
| Solv-1 | 0.34 |
| Layer 14: High-Speed Blue-Sensitive Emulsion Layer | |
| Silver Iodobromide Emulsion III (internally high AgI type having core/shell ratio of 1:2, sphere-equivalent diameter = 0.75 4 μm, variation coefficient of sphere-equivalent diameter = 25%) coated silver amount | 0.5 |
| Gelatin | 0.5 |
| ExS-6 | $1 \times 10^{-4}$ |
| ExY-9 | 0.01 |
| ExY-11 | 0.20 |
| ExC-1 | 0.02 |
| Solv-1 | 0.10 |
| Layer 15: 1st Protective Layer | |
| Fine Grain Silver Iodobromide Emulsion (AgI = 2 mol %, homogeneous AgI type, sphere-equivalent diameter = 0.07 μm) coated silver amount | 0.12 |
| Gelatin | 0.9 |
| UV-4 | 0.11 |
| UV-5 | 0.16 |
| Solv-5 | 0.02 |
| H-1 | 0.13 |
| Cpd-5 | 0.10 |
| Polyethylacrylate Latex | 0.09 |
| Layer 16: 2nd Protective Layer | |
| Fine Grain Silver Iodobromide Emulsion (AgI = 2 mol %, homogeneous AgI type, sphere-equivalent diameter = 0.07 μm) coating silver amount | 0.36 |
| Gelatin | 0.55 |
| Polymethylmethacrylate Grain (diameter = 1.5 μm) | 0.2 |
| H-1 | 0.17 |

UV: ultraviolet absorbent, Solv: high-boiling organic solvent, ExF: dye, ExS: sensitizing dye, ExC: cyan coupler, ExM: magenta coupler, ExY: yellow coupler, Cpd: additive In addition to the above components, a stabilizer Cpd-3 (0.07 g/m$^2$) for an emulsion and a surfactant Cpd-4 (0.03 g/m$^2$) were added as coating aids to each layer.

Formulas of the used compounds are listed in Table D.

An emulsion Em-201 was prepared following the same procedures as for the emulsion Em-1 of Example 1 except that the average sphere-equivalent diameter of seed crystals was changed to 0.5 μm and therefore the average sphere-equivalent diameter of final grains was changed to 0.75 μm.

Following the same procedures as in Example 1, gold-plus-sulfur sensitization was performed for the emulsion Em-201 to prepare an emulsion Em-202 of a comparative example. Following the same procedures as in Example 1, reduction sensitization in addition to gold-plus-sulfur sensitization was performed for the emulsion Em-201 by adding the ascorbic acid compound A-1, and the heterocyclic compound (1) having a mercapto compound was added in an amount of $1 \times 10^{-5}$ mol per mol of silver after reduction sensitization, thereby preparing an emulsion Em-203 of the present invention.

Following the same procedures as in Example 2, the emulsions Em-202 and Em-203 were spectrally sensitized to prepare emulsions. When the prepared emulsions were compared with each other as silver iodobromide emulsions for the layers 4, 8, and 14 following the same procedures as in Examples 3 and 6, the same effects of the present invention were confirmed.

TABLE A (1)

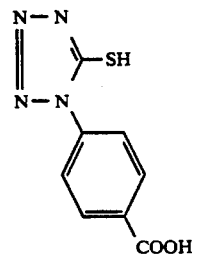

TABLE A-continued
(2)
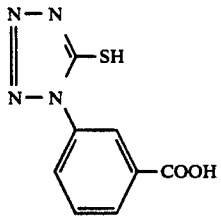
(3)
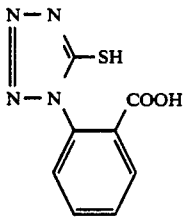
(4)
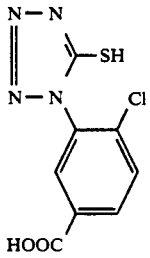
(5)
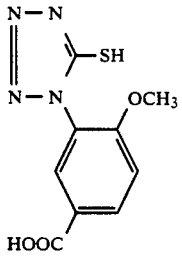
(6)
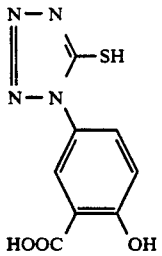
(7)
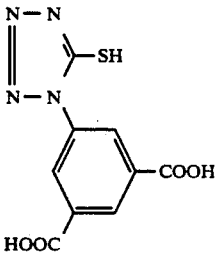
TABLE A-continued
(8)
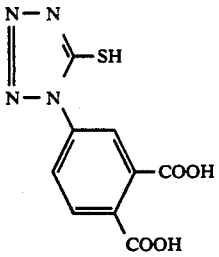
(9)
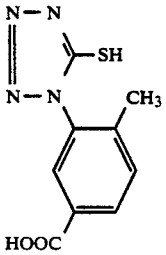
(10)
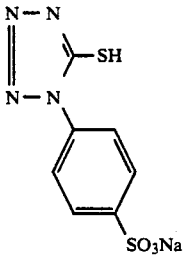
(11)
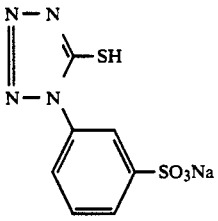
(12)
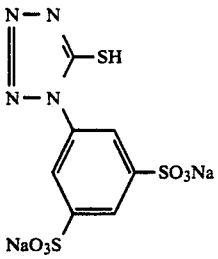
(13)
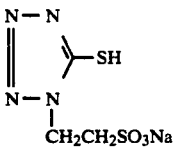
(14)
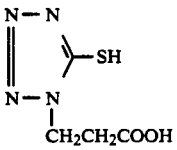

TABLE A-continued
(15)
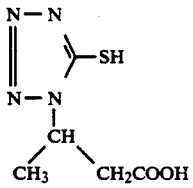
(16)
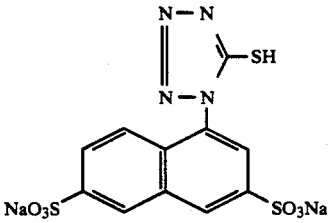
(17)
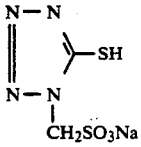
(18)
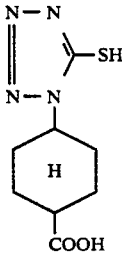
(19)
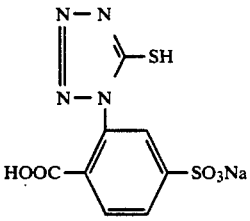
(20)
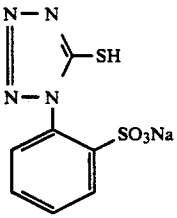
(21)
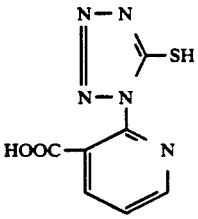
TABLE A-continued
(22)
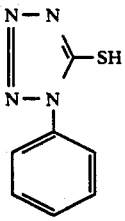
(23)
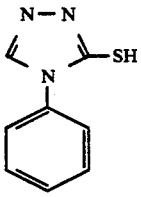
(24)
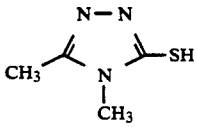
(25)
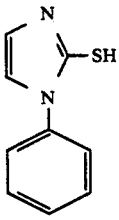
(26)
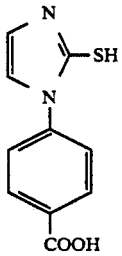
(27)
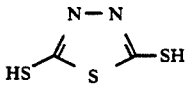
(28)
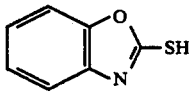
(29)
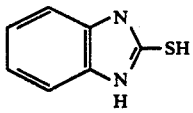
(30)
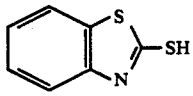
TABLE B
| U-1 | U-2 |
|---|---|

TABLE B-continued
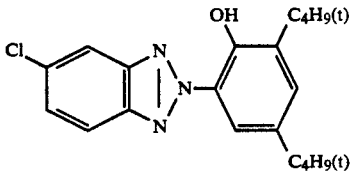
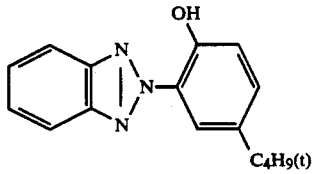
U-3
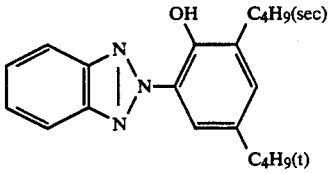
U-4
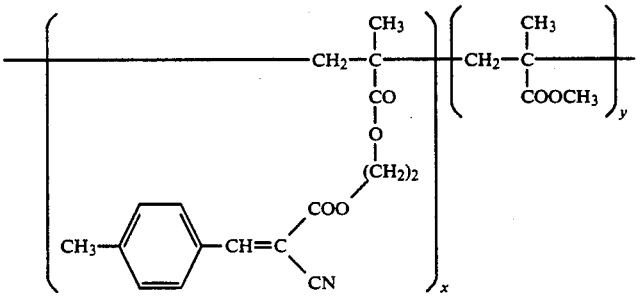
x:y = 7:3 (weight ratio)
U-5
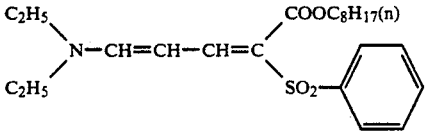
EX-1
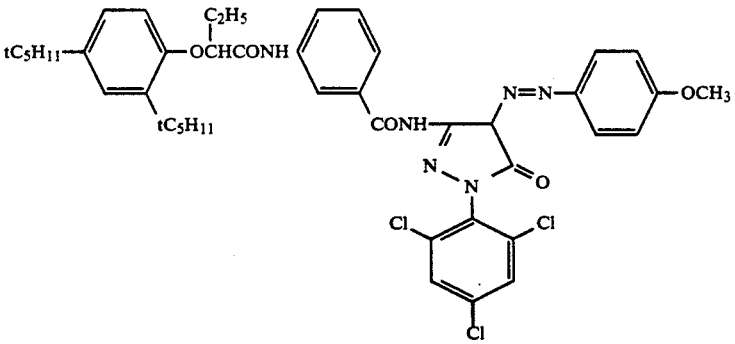
EX-2
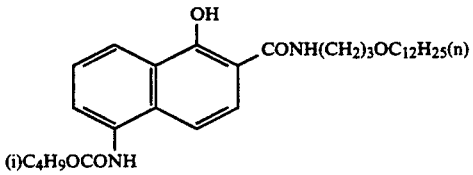
EX-3

TABLE B-continued
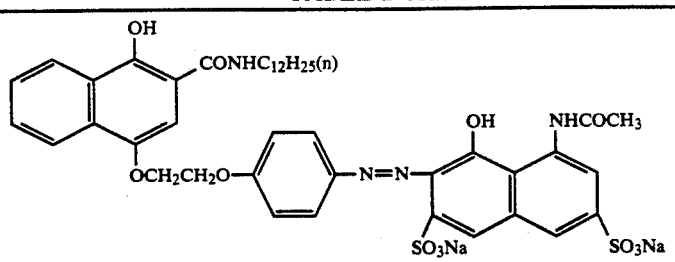
EX-4
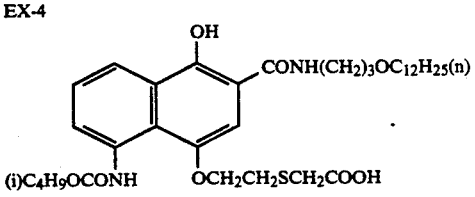
EX-5
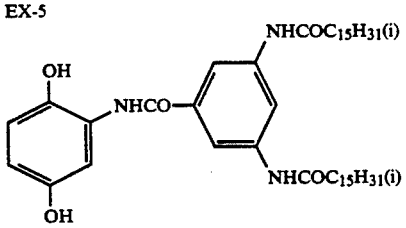
EX-6
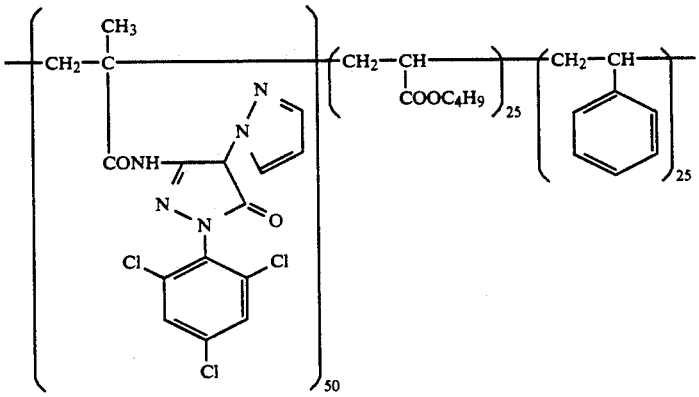
average molecular weight 30,000
EX-7
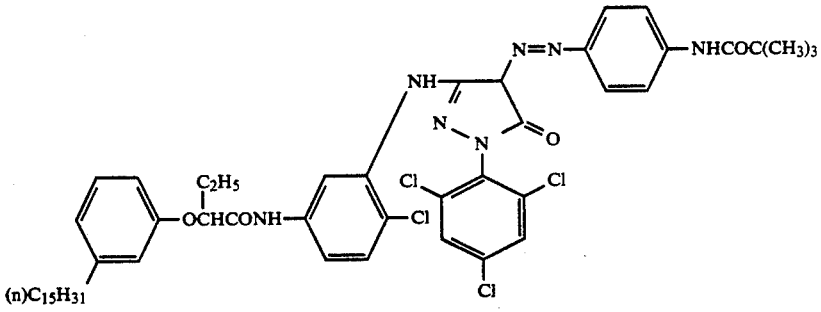
EX-8
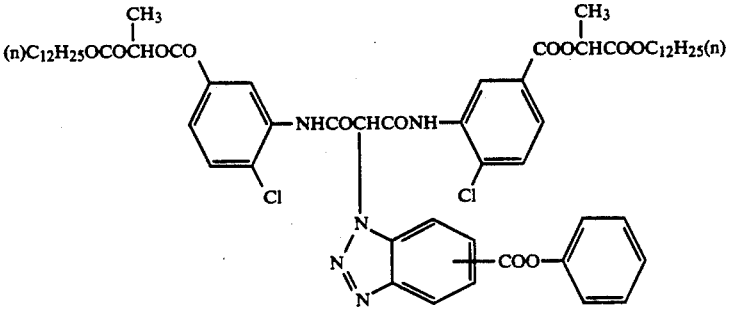
EX-9
EX-10

TABLE B-continued
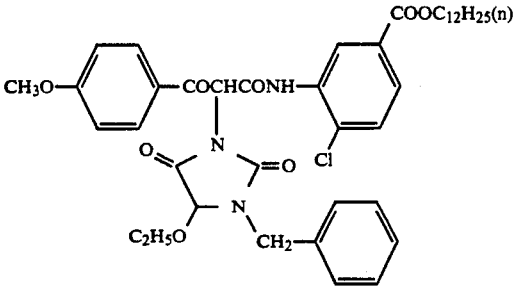
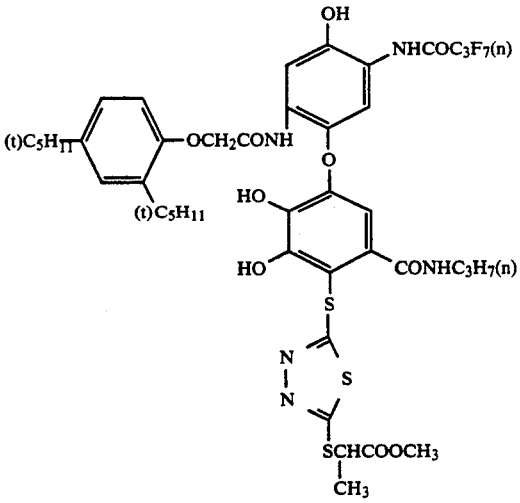
EX-11
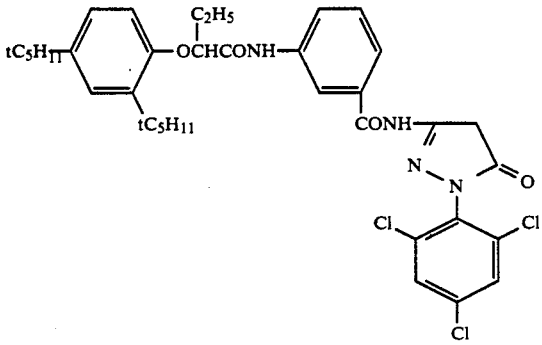
EX-12
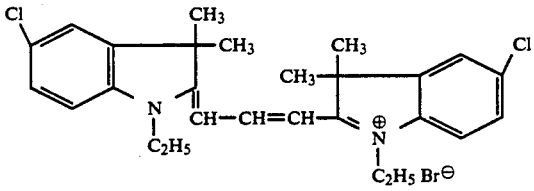
S-1
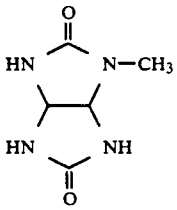
S-2
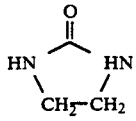
HBS-1
Tricresyl phosphate
HBS-2
Dibutyl phthalate
HBS-3
Bis(2-ethyl hexyl)phthalate
HBS-4
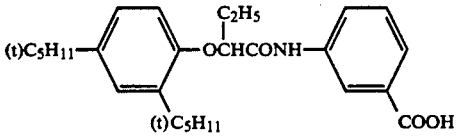
H-1
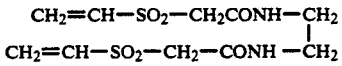
sensitizing dye
I
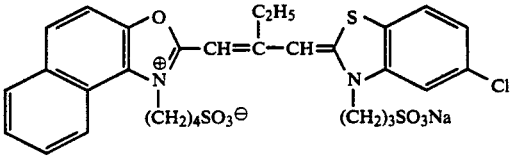
II
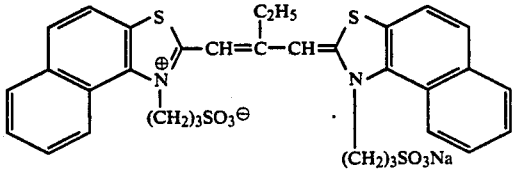
III
IV TABLE B-continued
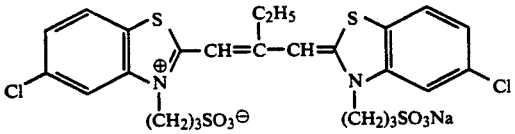
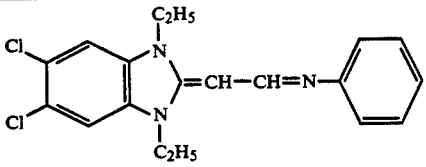
V
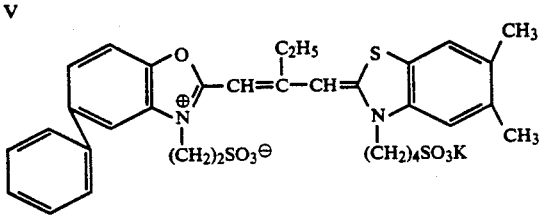
VI
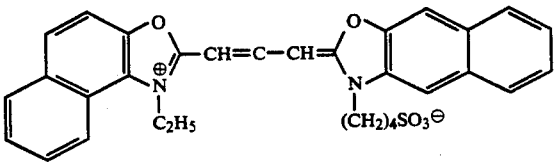
VII
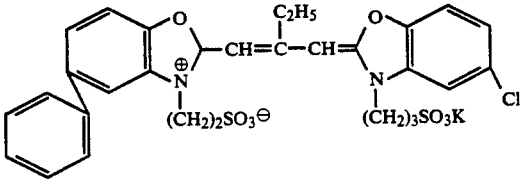
VIII
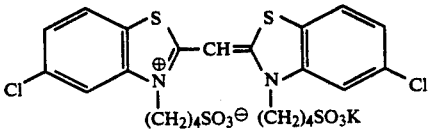
IX
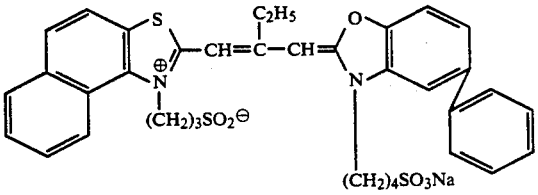
TABLE C
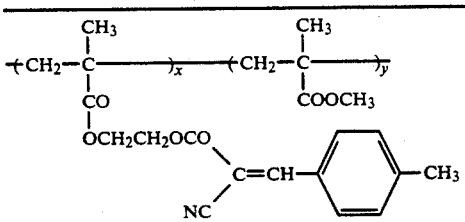
x/y = 7/3 (weight ratio)
UV-1
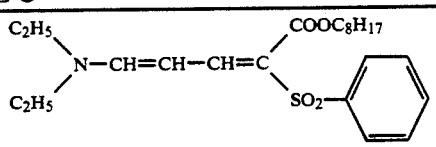
UV-2
ExM-3
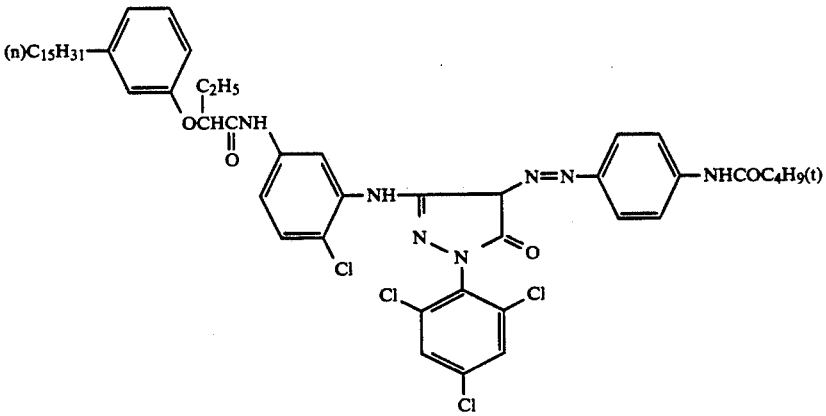

TABLE C-continued
ExC-1
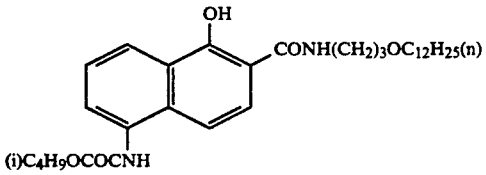
ExC-2
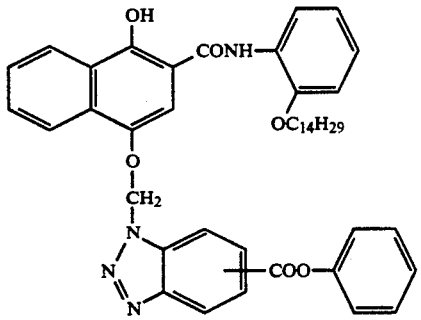
ExC-3
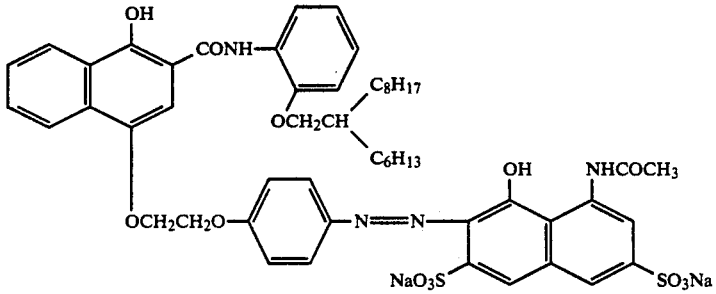
ExC-6
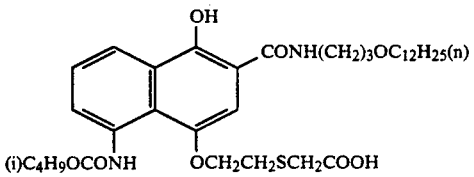
ExC-4
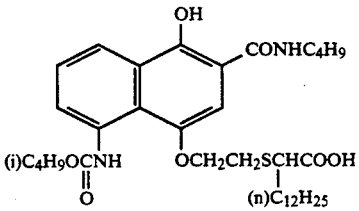
ExC-5
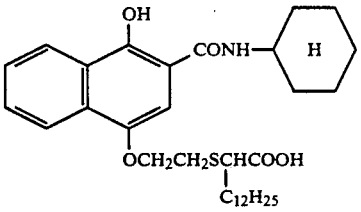
ExM-1
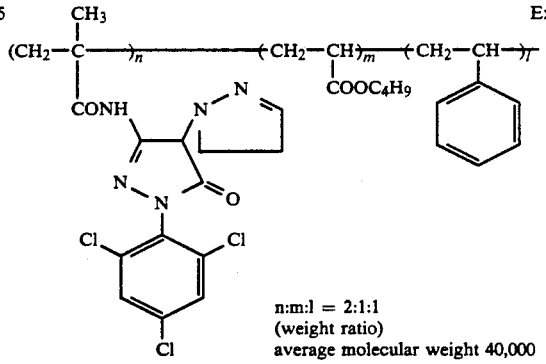
n:m:l = 2:1:1
(weight ratio)
average molecular weight 40,000
ExM-2
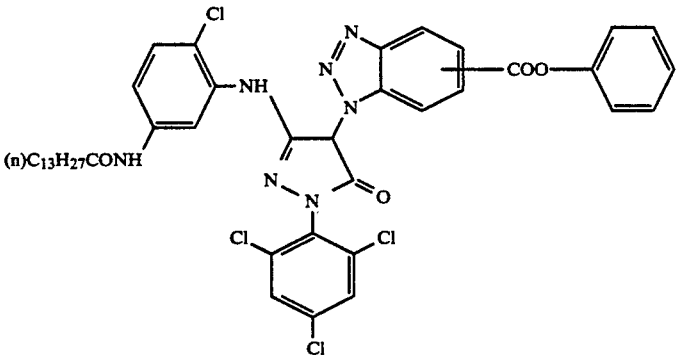

TABLE C-continued
ExM-4
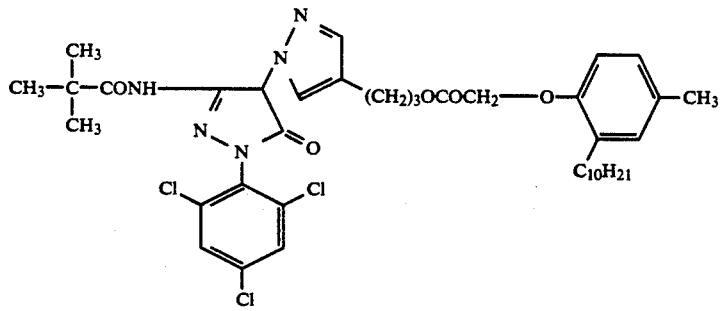
ExM-5
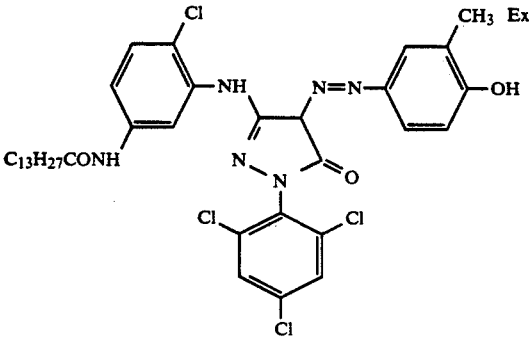
ExY-1
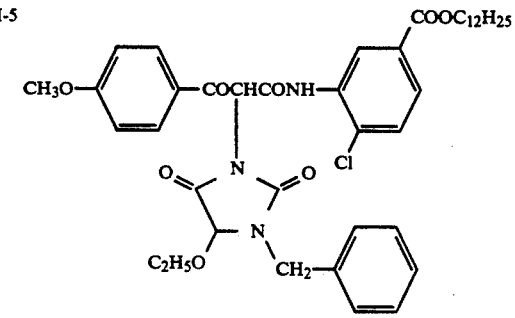
ExY-2
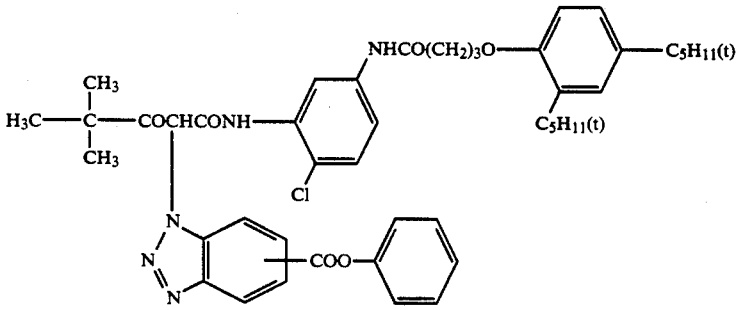
ExS-1
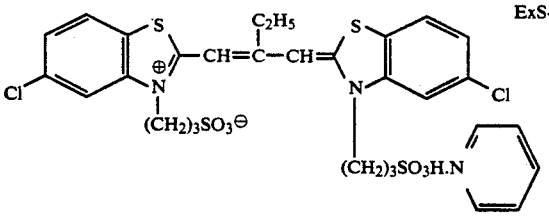
ExS-2
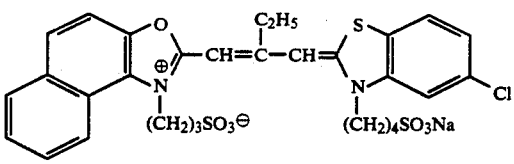
ExS-3
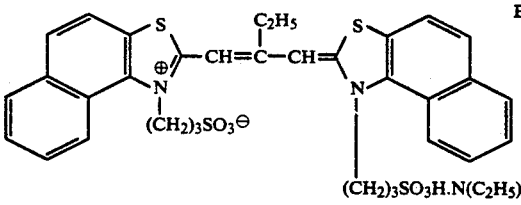
ExS-4
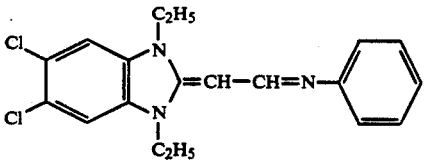
ExS-5
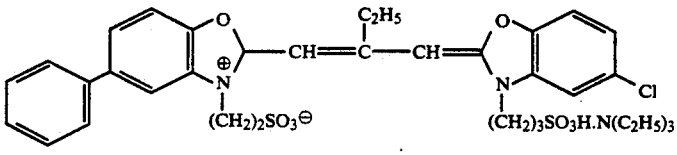

TABLE C-continued
ExS-6
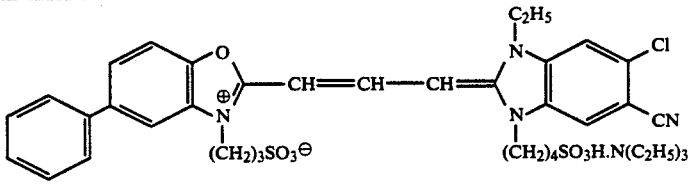
ExS-8
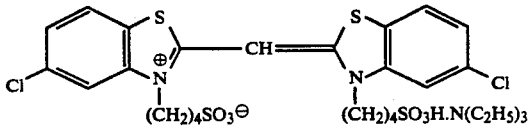
ExS-7
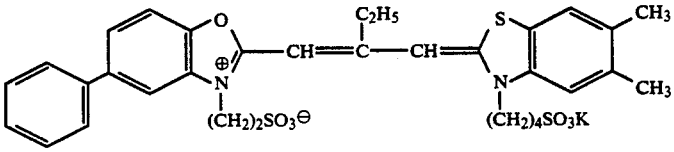
Solv-1
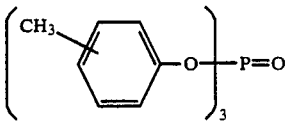
Solv-2
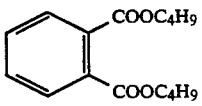
Solv-3
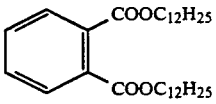
Solv-4
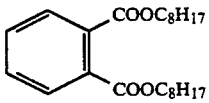
Solv-5
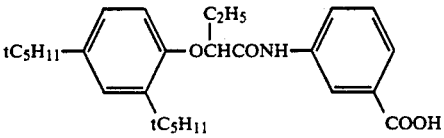
Cpd-1
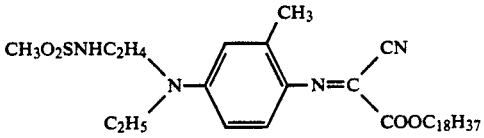
Cpd-2
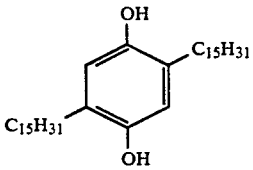
Cpd-3
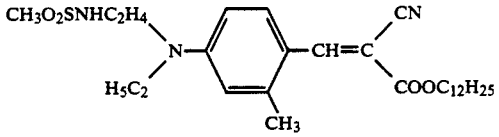
Cpd-4
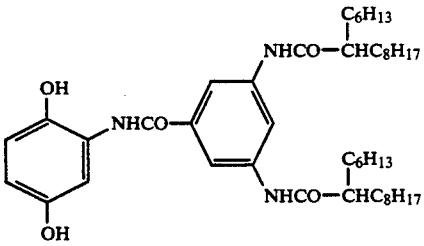
Cpd-5
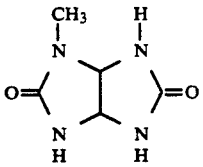
W-1
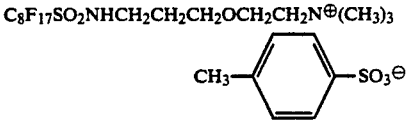
H-1
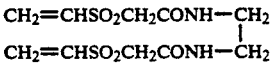
TABLE D
UV-1 UV-2

TABLE D-continued
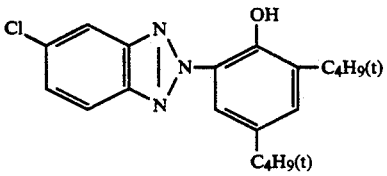
UV-3
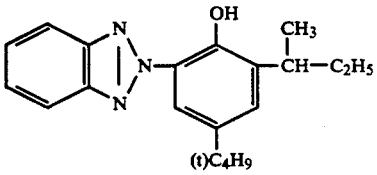
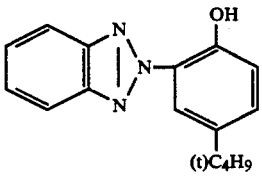
UV-4
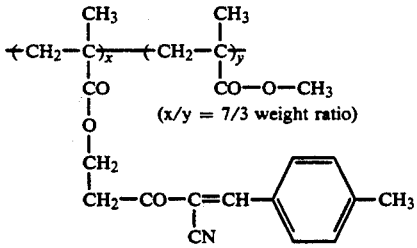
UV-5
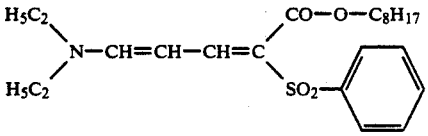
Solv-1
Tricresyl phosphate
Solv-2
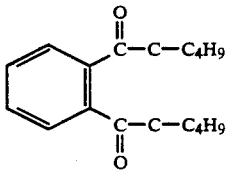
ExF-2
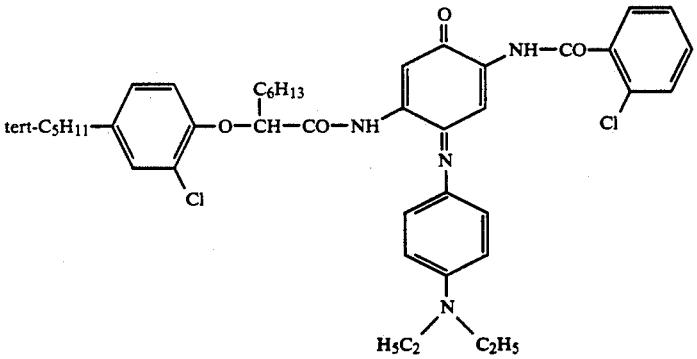
ExS-1
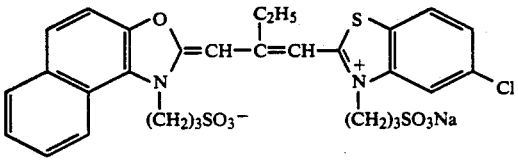
Solv-4
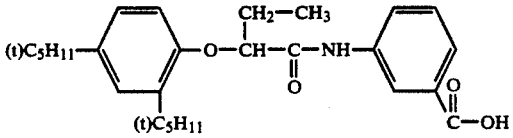
Solv-5
ExF-1

TABLE D-continued
Trihexyl phosphate
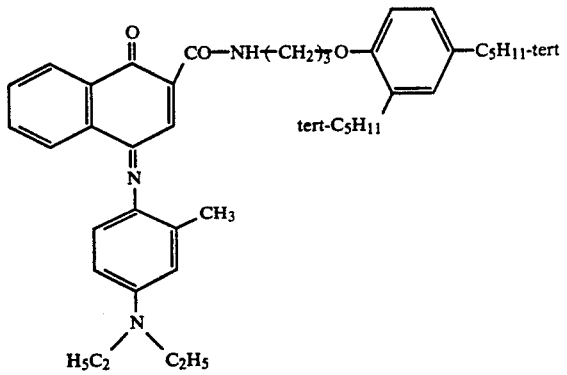
ExS-2
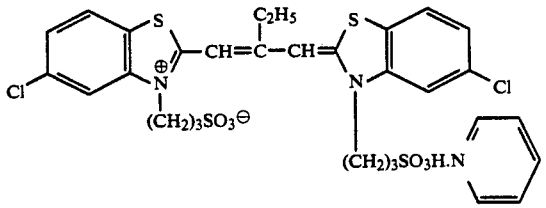
ExS-3
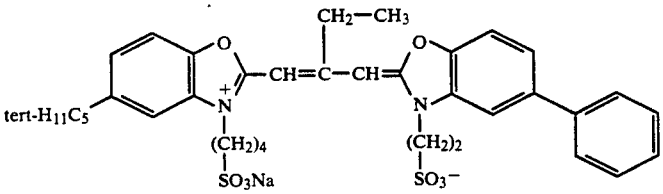
ExS-4
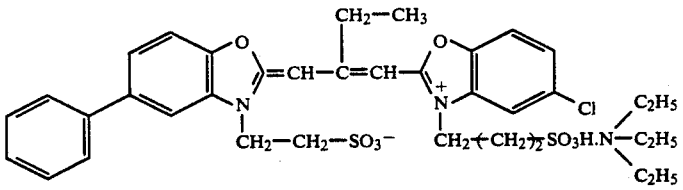
ExS-5
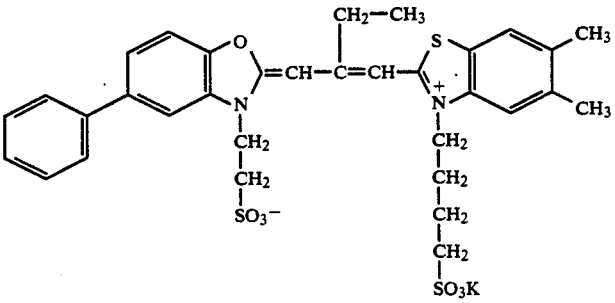
ExS-6
ExS-7

TABLE D-continued
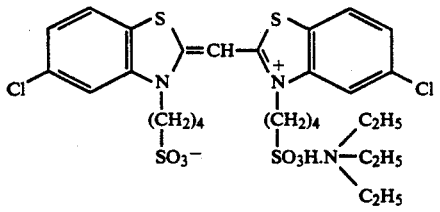
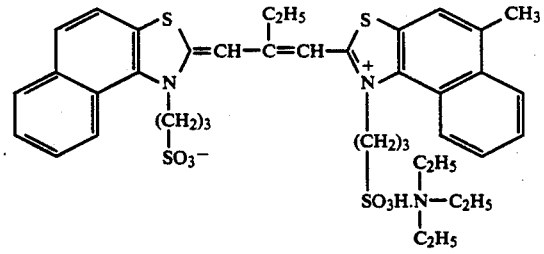
ExS-8
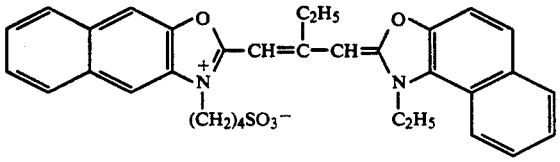
ExC-1
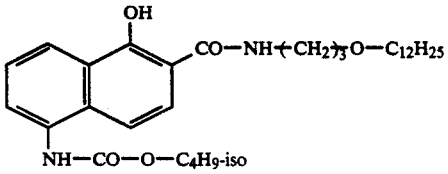
ExC-2
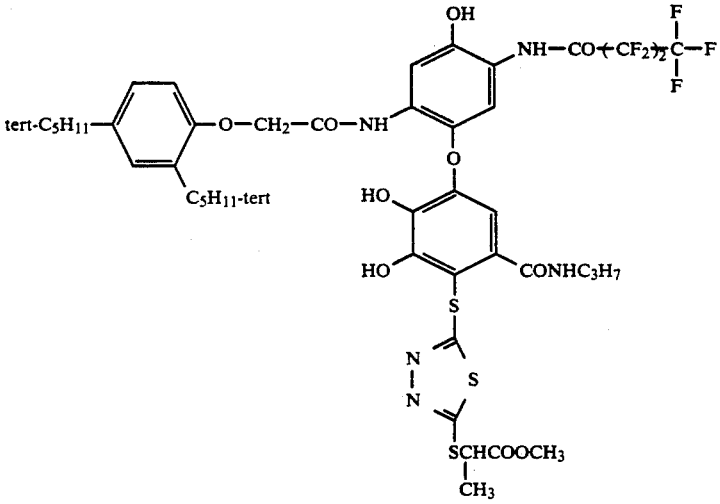
ExC-3
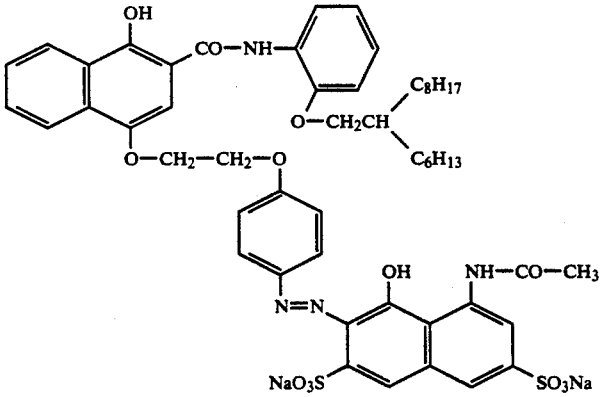
ExC-4
ExM-5

TABLE D-continued
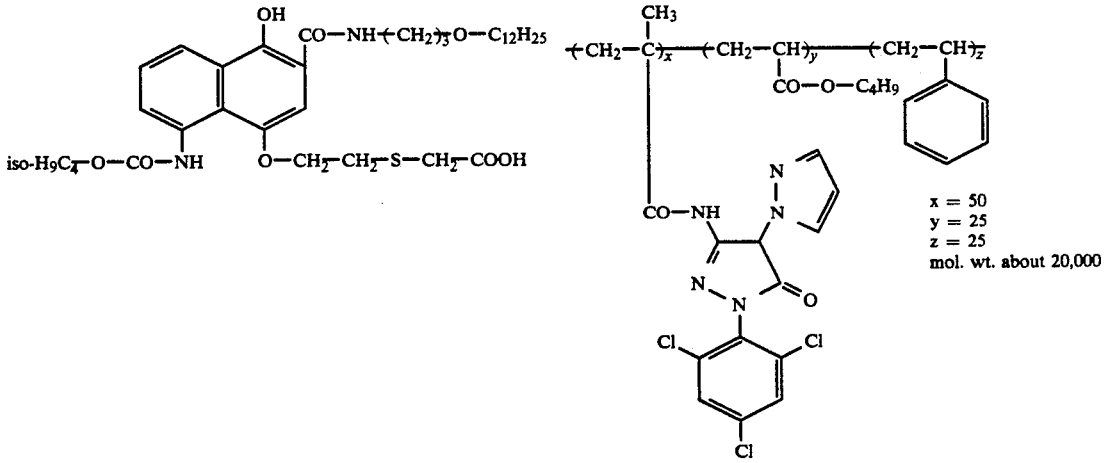
ExM-6
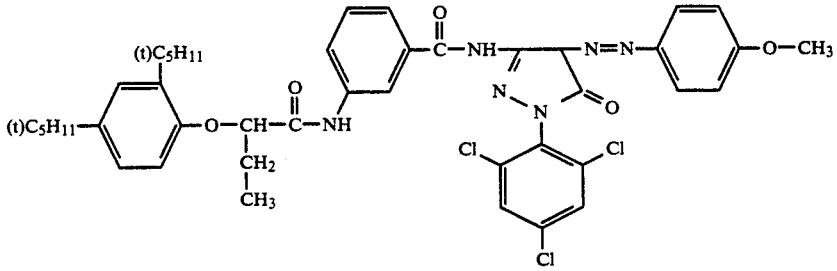
ExM-7
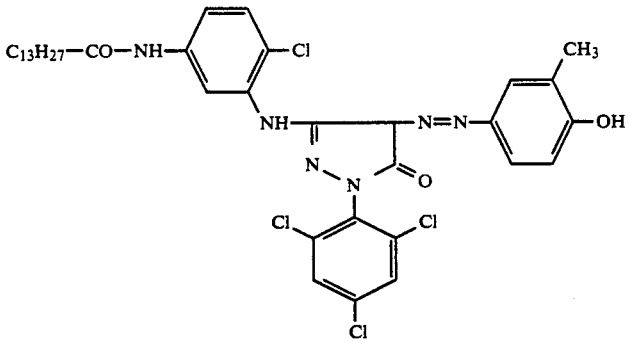
ExM-10
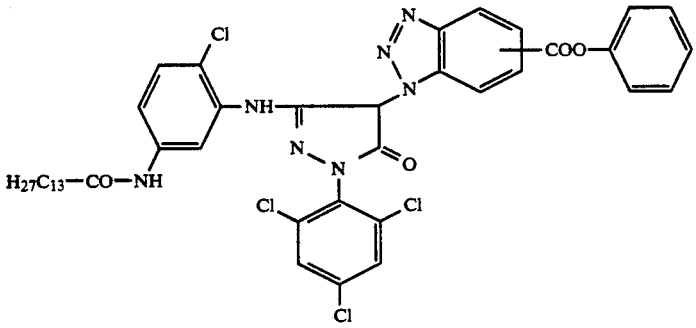
ExY-8

TABLE D-continued
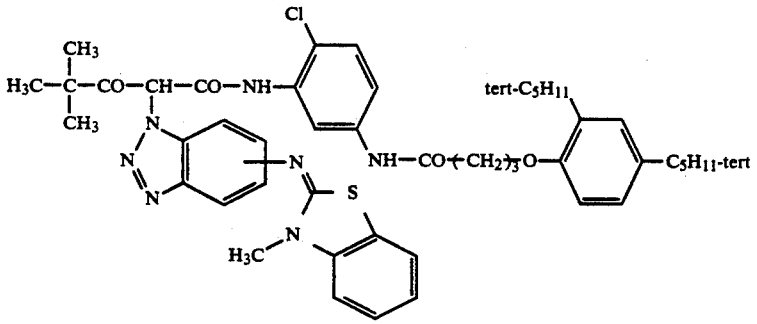
ExY-9
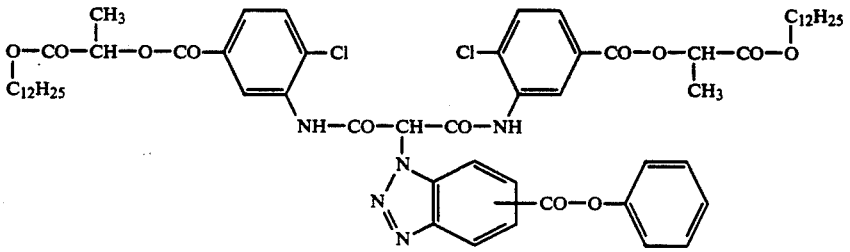
ExY-11
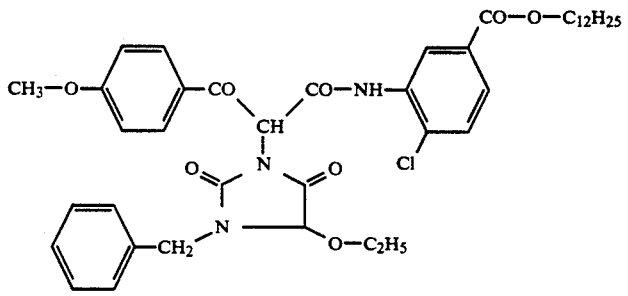
ExY-12
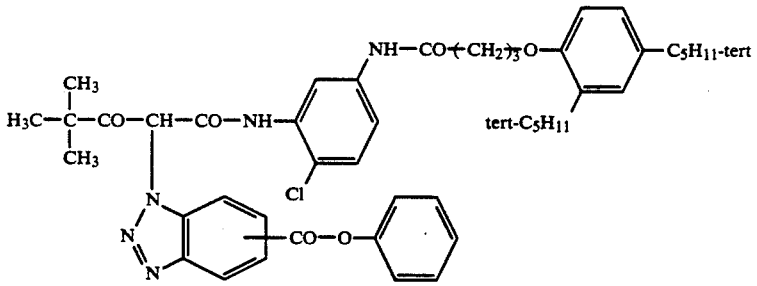
CPd-7
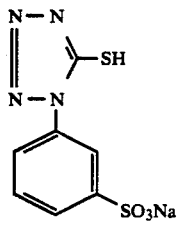
Cpd-1
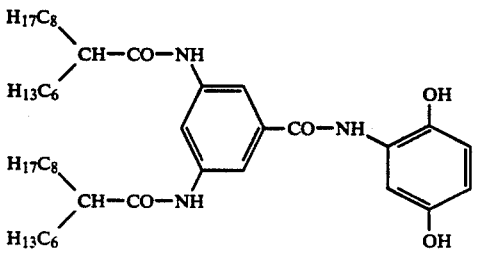
Cpd-2

TABLE D-continued

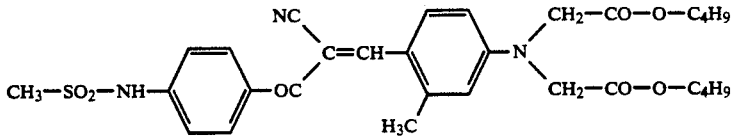

Cpd-6

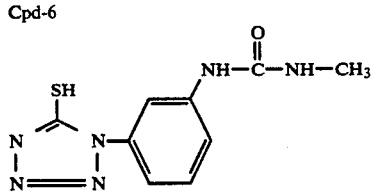

H-1

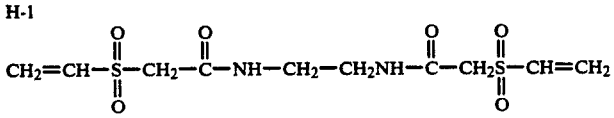

Cpd-5

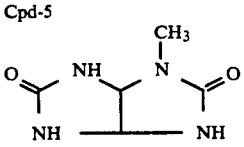

Cpd-3

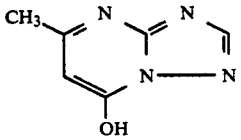

Cpd-4

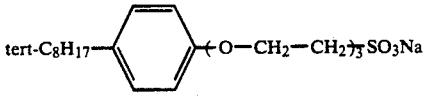

What is claimed is:

1. A silver halide photographic light-sensitive material comprising, on a support thereof, an emulsion layer containing silver halide grains reduction-sensitized by an ascorbic acid or at least one derivative thereof and containing a nitrogen-containing heterocyclic compound having a mercapto group, wherein the ascorbic acid or at least one derivative thereof for use in reduction-sensitization is added in an amount of $5\times10^{-5}$ mol to $1\times10^{-1}$ mol per mol of silver halide.

2. The silver halide photographic material according to claim 1, wherein said nitrogen-containing heterocyclic compound having a mercapto group is represented by formula (I):

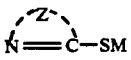

(I)

wherein Z represents a non-metallic atom group required to form a nitrogen-containing heterocyclic ring, and M represents a hydrogen atom, an alkali metal, quaternary ammonium, or quaternary phosphonium.

3. The silver halide photographic material according to claim 2, wherein said nitrogen-containing heterocyclic compound having a mercapto group is represented by formula (II):

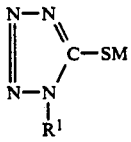

(II)

wherein $R^1$ represents an aliphatic group, an aromatic group, or a heterocyclic group each substituted by at least one —COOM or —$SO_3M$, and M has the same meaning as in said formula (I).

4. The silver halide photographic material according to claim 3, wherein, in formula (II), R' represents a group substituted by at least one —COOM or —$SO_3M$.

5. The silver halide photographic material according to claim 1, wherein an amount of the ascorbic acid or at least one derivative thereof for use in reduction-sensitization is $5\times10^{-4}$ mol to $1\times10^{-2}$ mol per mol of a silver halide.

6. The silver halide photographic material according claim 1, wherein the silver halide grains are reduction-sensitized by an ascorbic acid.

7. The silver halide photographic material according to claim 2, wherein an amount of the nitrogen-containing heterocyclic compound having a mercapto group represented by formula (I) is $10^{-6}$ mol to $10^{-2}$ mol per mol of a silver halide.

8. The silver halide photographic material according to claim 1, wherein the emulsion layer further contains at least one compound in an amount of $10^{-7}$ mol to $10^{-1}$ mol per mol of a silver halide, the compound being selected from the compounds represented by formulas (IV), (V), and (VI):

$R—SO_2S—M$ (IV)

$R—SO_2S—R^1$ (V)

$R—SO_2S—Lm—SSO_2—R^2$ (VI)

wherein R, $R^1$, and $R^2$ can be the same or different and represent an aliphatic group, an aromatic group, or a heterocyclic group, M represents a cation, L represents a divalent bonding group, and m represents 0 or 1.

9. The silver halide photographic material according to claim 1, wherein the silver halide grain is a single twinned crystal or a parallel multiple twinned crystal.

10. The silver halide photographic material according to claim 1, wherein the emulsion is a monodispersed emulsion.

11. The silver halide photographic material according to claim 1, wherein the silver halide grains are tabular grains in which grains having an aspect ratio of 3 to 8 occupy 50% or more of a total projected surface area.

12. The silver halide photographic material according to claim 1, wherein the silver halide grain is a silver iodobromide grain having a high silver iodide content at a core portion and a low silver iodide content at a shell portion.

13. The silver halide photographic material according to claim 1, wherein the silver halide grain is a silver iodobromide grain having a high silver iodide content at a shell portion and a low silver iodide content at a core portion.

14. The silver halide photographic light-sensitive material according to claim 1, wherein the ascorbic acid or derivative thereof is selected from the group consisting of ascorbic acid, L-ascorbic acid, sodium L-ascorbate, potassium L-ascorbate, DL-ascorbic acid, sodium D-ascorbate, L-ascorbic acid 6-acetate, L-ascorbic acid 6-palmitate, L-ascorbic acid 6-benzoate, L-ascorbic acid 5,6-diacetate and L-ascorbic acid 5,6-O-isopropylidene.

15. The silver halide photographic light-sensitive material according to claim 3, wherein:

the aliphatic group is a straight-chain or branched alkyl group having 1 to 20 carbon atoms, or a cycloalkyl group having 1 to 20 carbon atoms, the aromatic group is an aryl group having 6 to 20 carbon atoms, and the heterocylic group is a 5-, 6-, or 7-membered heterocyclic ring containing one or more nitrogen, oxygen or sulfur atoms.

16. The silver halide photographic light-sensitive material according to claim 3, wherein said nitrogen-containing heterocyclic compound having a mercapto group is represented by formula (III):

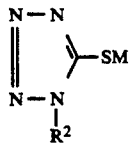

(III)

wherein $R^2$ represents a phenyl group substituted by at least one of —COOM or —$SO_3M$, and M has the same meaning as in formula (I).

17. The silver halide photographic light-sensitive material according to claim 8, wherein the aliphatic group is an alkyl group having 1 to 22 carbon atoms or an alkenyl or alkynyl group having 2 to 22 carbon atoms.

18. The silver halide photographic light-sensitive material according to claim 8, wherein the aromatic group has 6 to 20 carbon atoms.

19. The silver halide photographic light-sensitive material according to claim 8, wherein the heterocyclic group includes a 3-to 15-membered ring having at least one element of nitrogen, oxygen, sulfur, selenium or tellurium.

20. The silver halide photographic light-sensitive material according to claim 8, wherein L represents a divalent aliphatic group or a divalent aromatic group.

21. The silver halide photographic light-sensitive material according to claim 8, wherein M is a metal ion or an organic cation.

* * * * *